US008147163B2

(12) United States Patent
Bare et al.

(10) Patent No.: US 8,147,163 B2
(45) Date of Patent: Apr. 3, 2012

(54) TIRE RAPID ENTANGLEMENT AND ARRESTING DEVICE

(75) Inventors: Cleve Ivan Bare, Peoria, AZ (US); Brian John Smyth, Phoenix, AZ (US); John David Pye, Scottsdale, AZ (US)

(73) Assignee: Exponent, Inc., Phoenix, AZ (US)

( * ) Notice: Subject to any disclaimer, the term of this patent is extended or adjusted under 35 U.S.C. 154(b) by 170 days.

(21) Appl. No.: 12/354,673

(22) Filed: Jan. 15, 2009

(65) Prior Publication Data

US 2010/0178104 A1 Jul. 15, 2010

(51) Int. Cl.
*E01F 13/12* (2006.01)

(52) U.S. Cl. ..... 404/6

(58) Field of Classification Search ..... 404/6, 9; 256/1, 13.1

See application file for complete search history.

(56) References Cited

U.S. PATENT DOCUMENTS

| | | | | |
|---|---|---|---|---|
| 4,318,079 | A | 3/1982 | Dickinson | 340/127 |
| 4,759,655 | A | 7/1988 | Gorlov | 404/6 |
| 4,818,137 | A | 4/1989 | Gorlov | 404/6 |
| 4,923,327 | A | 5/1990 | Gorlov | 404/6 |
| 5,026,230 | A | 6/1991 | Dolezych et al. | 410/100 |
| 5,301,277 | A | 4/1994 | Kanai | 395/275 |
| 5,310,277 | A * | 5/1994 | Uotila | 404/6 |
| 5,330,285 | A | 7/1994 | Greves et al. | 404/6 |
| 5,498,102 | A | 3/1996 | Bissell | 404/6 |
| 5,634,738 | A | 6/1997 | Jackson et al. | 404/6 |

(Continued)

FOREIGN PATENT DOCUMENTS

EP 1 873 315 A1 1/2008

(Continued)

OTHER PUBLICATIONS

Solicitation, Offer and Award, Solicitation No. W91CRB-08-R-0112 (49 pgs) dated Oct. 21, 2008.

(Continued)

*Primary Examiner* — Raymond Addie
(74) *Attorney, Agent, or Firm* — Hayes Soloway P.C.; Huw R. Jones, Esq.

(57) ABSTRACT

A method and apparatus for inhibiting the motion of a vehicle comprising a housing having a cavity, the cavity adapted to contain a net so that the net may be made available for release on command; tire engagement spikes supported by the housing, the spikes being movable to a first position to engage the tires of an oncoming vehicle, the spikes also being movable to a second position to avoid tire engagement, the spikes being positioned to grasp the net when in the first position; and an actuator for moving the spikes between the first and the second positions on command, wherein the spikes comprise at least two barbs adapted to penetrate a pneumatic tire, the spikes also having a hook for grasping a loop of the leading edge of the net. The method of the invention is a method of inhibiting the motion of a moving vehicle comprising the steps of providing a housing in the path of the vehicle, the housing being adapted to releasably contain a net having spikes arranged at a leading edge of the net; transmitting an electronic command manually to a motor that exposes the spikes to the moving vehicle; engaging the tires of the moving vehicle with the spikes by puncturing them; pulling the net from the housing by wrapping the net around the tires as the tires continue to move forward; and limiting continued forward motion by tightening the net around the axles thereby ultimately constraining the tires from further rotation.

41 Claims, 28 Drawing Sheets

U.S. PATENT DOCUMENTS

| | | | | |
|---|---|---|---|---|
| 5,775,832 | A | 7/1998 | Kilgrow et al. | 404/6 |
| 5,890,832 | A | 4/1999 | Soleau | 404/6 |
| 6,048,128 | A | 4/2000 | Jones, III et al. | 404/6 |
| 6,062,765 | A | 5/2000 | Dotson | 404/6 |
| 6,220,781 | B1 | 4/2001 | Miller | 404/6 |
| 6,312,188 | B1 | 11/2001 | Ousterhout et al. | 404/6 |
| 6,322,285 | B1 | 11/2001 | Ben | 404/6 |
| 6,409,420 | B1 | 6/2002 | Horton et al. | 404/6 |
| 6,443,385 | B1 | 9/2002 | Grandauer et al. | 242/476.7 |
| 6,474,903 | B1 | 11/2002 | Marts et al. | 404/6 |
| 6,896,443 | B1 * | 5/2005 | Ousterhout et al. | 404/6 |
| 7,056,054 | B1 | 6/2006 | Keith et al. | 404/6 |
| 7,121,760 | B1 * | 10/2006 | Curry, Jr. | 404/6 |
| 7,125,197 | B2 | 10/2006 | Krewsun et al. | 404/6 |
| 7,179,015 | B1 | 2/2007 | Rittenhouse et al. | 404/6 |
| 7,195,419 | B2 * | 3/2007 | Gelfand | 404/6 |
| 7,201,531 | B2 | 4/2007 | Shackelford et al. | 404/6 |
| 7,210,875 | B1 * | 5/2007 | Christle et al. | 404/6 |
| 7,220,076 | B2 | 5/2007 | Boll | 404/6 |
| 7,226,238 | B2 | 6/2007 | Collier | 404/6 |
| 2005/0214071 | A1 * | 9/2005 | Collier | 404/6 |
| 2005/0244223 | A1 * | 11/2005 | Shackelford et al. | 404/6 |
| 2006/0140715 | A1 * | 6/2006 | Lyddon et al. | 404/6 |
| 2006/0245828 | A1 * | 11/2006 | Jonasz et al. | 404/15 |
| 2007/0140791 | A1 * | 6/2007 | Gelfand | 404/6 |
| 2009/0317185 | A1 * | 12/2009 | Coomber et al. | 404/6 |
| 2010/0196092 | A1 * | 8/2010 | Castro et al. | 404/6 |

FOREIGN PATENT DOCUMENTS

| | | | |
|---|---|---|---|
| WO | WO2004/072382 | A1 | 8/2004 |

OTHER PUBLICATIONS

Minotaur Proposal dated Sep. 19, 2007, 15 pgs.

* cited by examiner

TIRE RAPID ENTANGLEMENT AND ARRESTING DEVICE

STATEMENT AS TO RIGHTS TO INVENTIONS MADE UNDER FEDERALLY-FUNDED RESEARCH

The U.S. Government has a paid-up license in this invention and the right in limited circumstances to require the patent owner to license others on reasonable terms as provided for by the terms of Contract No. W91CRB-07-D-0013 awarded by the United States Army.

BACKGROUND

1. Field of the Invention

The embodiments of the invention are directed to an apparatus and method for stopping moving vehicles by external means. Specifically, apparatus are provided which employ a housing containing a net that entangles the wheels to the point of loss of rotational motion, thereby causing the vehicle to skid to a stop.

2. Description of Related Art

While conducting checkpoint operations or providing security for fixed locations, the military and/or state and local officials have the need to selectively stop vehicles while searching for weapons, wanted persons or illegal contraband. During these checkpoint operations, it is important for police to have a non-lethal tool that can effectively stop a vehicle that fails to proceed as directed.

While there are a wide range of mechanisms available that attempt to immobilize moving vehicles, current tools suffer issues with portability, selectivity, and effectiveness. Devices that are sufficiently small enough to be transportable and work by deflating tires are not generally effective at stopping vehicles within an appropriate distance. Those devices that are portable and can stop vehicles within appropriate distances are generally not selective (stopping all traffic when deployed and not able to quickly disarm/arm to allow friendly traffic to pass.) Larger, more permanent devices (i.e. full vehicle entrapment or barrier systems) often have the ability to be selectively armed, but require a large infrastructure investment to install and cannot typically be relocated as checkpoint or vehicle entry points change.

SUMMARY OF THE INVENTION

An embodiment of the invention is directed to an apparatus for inhibiting the rotation of the tires of a vehicle comprising a housing adapted to releasably contain a net having spikes arranged at a leading edge of the net and an actuator that transmits an electronic command to expose the spikes to the moving vehicle. The housing of the apparatus may be located below ground or above ground. The apparatus may also include a ramp for oncoming traffic whereby the oncoming traffic will normally slow in response to the presence of the ramp. The apparatus may have multiple sections that interlock with one another and together house a single unitary net. Another embodiment of the invention includes separate housing sections, each section individually housing an individual net, respectively, and each net having connectors at its lateral periphery that connect the individual nets to each other. The net of the present embodiment comprises a leading edge adapted to engage the tires and a trailing edge. The leading edge further comprises loops of material connected to or integral with the net, the loops forming an opening sufficient to allow the spikes to grasp the net when the housing is actuated to the "spikes exposed" position. The trailing edge of the net is connected to a releasable elastic restraining element such as a bungee cord whereby upon being fully stretched the bungee cords will tear away from the housing. The longitudinal edges of the net comprise lateral stringers attached at an inner cell junction and threaded through the cells towards the edge. The stringers thread through net cells along the edge, and then through cells laterally inward, where they attach at another inner cell junction. A cartridge containing the net is used to store and transport nets, which are only used once and then may be disposed of. The spikes may be deployed singly or, in a preferred embodiment, the spikes comprise at least two barbs adapted to penetrate a pneumatic tire, the spikes also having a hook or similar device for grasping a loop of the leading edge of the net. The spikes are supported on a platform that is movable between the exposed and unexposed positions. Within the housing are supporting ledges for the spikes. In order to actuate the housing, electromagnetic signals are sent to the housing for positioning the spikes in the spikes exposed or spikes unexposed positions. The actuator may comprise a wirelessly-activated electric motor, or it may be a hard-wired connection.

Another embodiment of the present invention is an apparatus for inhibiting the motion of a vehicle comprising a housing having a cavity, the cavity adapted to contain a net so that the net may be made available for release on command; tire engagement spikes supported by the housing, the spikes being movable to a first position to engage the tires of an oncoming vehicle, the spikes also being movable to a second position to avoid tire engagement, the spikes being positioned to grasp the net when in the first position; and an actuator for moving the spikes between the first and the second positions on command.

Another embodiment of the invention is a method for inhibiting the motion of a moving vehicle, comprising the steps of providing a housing in the path of the vehicle, the housing being adapted to releasably contain a net having spikes arranged at a leading edge of the net; and transmitting an electronic command manually to a motor that exposes the spikes to the moving vehicle. The method further comprises the step of transmitting an electronic command automatically to a motor that exposes the spikes to the moving vehicle. The vehicle may be selected from amongst a group of vehicles, thereby adding a degree of selectivity to the invention. The method further includes engaging the front tires of the vehicle by puncturing them with the spikes and then wrapping the net around the front tires as they continue to rotate, tightening the net around the axles of the vehicle and stopping continued forward rotation whereby forward motion is significantly constrained.

Another embodiment of the present invention is a method of inhibiting the motion of a moving vehicle comprising the steps of providing a housing in the path of the vehicle, the housing being adapted to releasably contain a net having spikes arranged at a leading edge of the net; transmitting an electronic command manually to a motor that exposes the spikes to the moving vehicle; engaging the tires of the moving vehicle with the spikes by puncturing them; pulling the net from the housing by wrapping the net around the tires as the tires continue to move forward; and limiting continued forward motion by tightening the net around the axles thereby ultimately constraining the tires from further rotation.

Another embodiment of the invention is a net comprising a body, the body comprising a series of diamond-shaped interwoven cells formed from the interconnection of strands of rope or other linear material, a leading edge adapted to engage tires of a vehicle, the leading edge comprising loops or partially disconnected cells of material integrally connected to said net, a trailing edge having elastic components attached intermittently to the trailing edge of the net in breakaway design; and edge treatments comprising stringers that laterally traverse the edge of said net from the outer portion of said net to a position inboard, the length of said stringer being sufficient to cinch tires as they are enwrapped.

DETAILED DESCRIPTION OF EMBODIMENTS OF THE INVENTION

1. Overview

The inventors have developed the Tire Rapid Entangling and Arresting Device (TREAD) specifically to meet the modern requirements of stopping vehicles safely and controllably by use of external means. One application is a checkpoint stop. Initial testing clearly established that the TREAD, while small enough to be portable within common police and military vehicles, could deploy a net system from a speed bump-shaped module and stop passenger cars and light trucks at speeds of 30 mph within 100 feet. Initial tests on Class-8 tractors ballasted up to 50,000 pounds have also shown that the TREAD can be effective against this size vehicle; however stopping distances are highly dependant on the total vehicle mass. In all tests, vehicle speed was significantly affected and the steering control limited immediately after the TREAD was engaged and generally, the vehicle is quickly brought to a complete stop.

The various embodiments of the invention are directed to apparatus and methods for inhibiting the rotation of the tires of a vehicle comprising a housing adapted to releasably contain a net having spikes arranged at a leading edge of the net, and an actuator that transmits an electronic command to expose the spikes to the vehicle. The general operational concept is that as the vehicle approaches the apparatus, the checkpoint operator selects the vehicle to be stopped after the vehicle's driver has missed or disobeyed a command to stop. As the vehicle rolls over the exposed spikes, the spikes are embedded in the tires, the continued forward motion of the vehicle draws the attached net out of the housing, the net entangles the wheels, tightens, and finally prevents further wheel rotation.

The inventive method includes inhibiting the motion of the moving vehicle comprising the steps of providing the aforementioned housing in the path of the vehicle, the housing being adapted to releasably contain a net having spikes arranged at a leading edge of the net, transmitting an electronic command manually to an actuator that exposes the spikes to the moving vehicle, engaging the tires of the moving vehicle with the spikes by puncturing them, pulling the net from the housing by wrapping the net around the tires as the tires continue to move forward, and finally limiting continued forward motion by self-tightening of the net around the axles thereby ultimately constraining the tires from further rotation.

Figure 2:
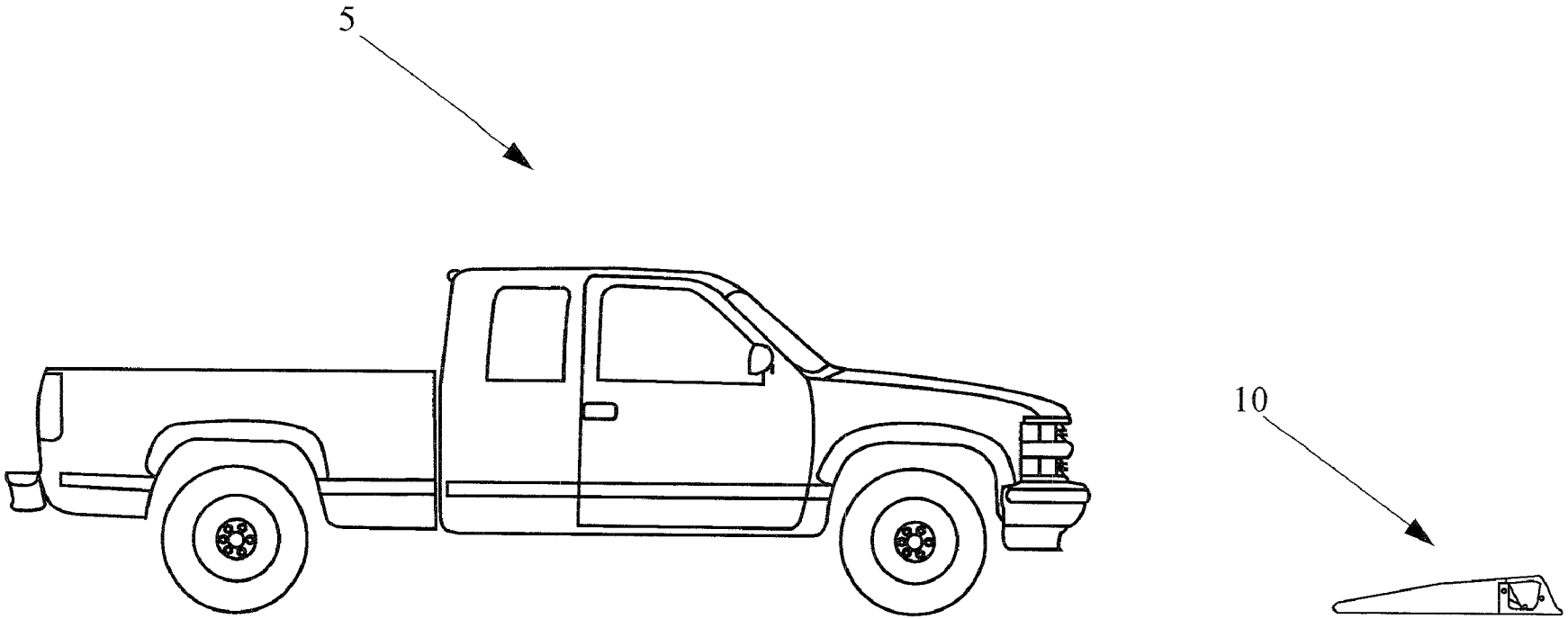
FIG. 2 is an illustration of a pickup truck approaching the TREAD.
Figure 3:
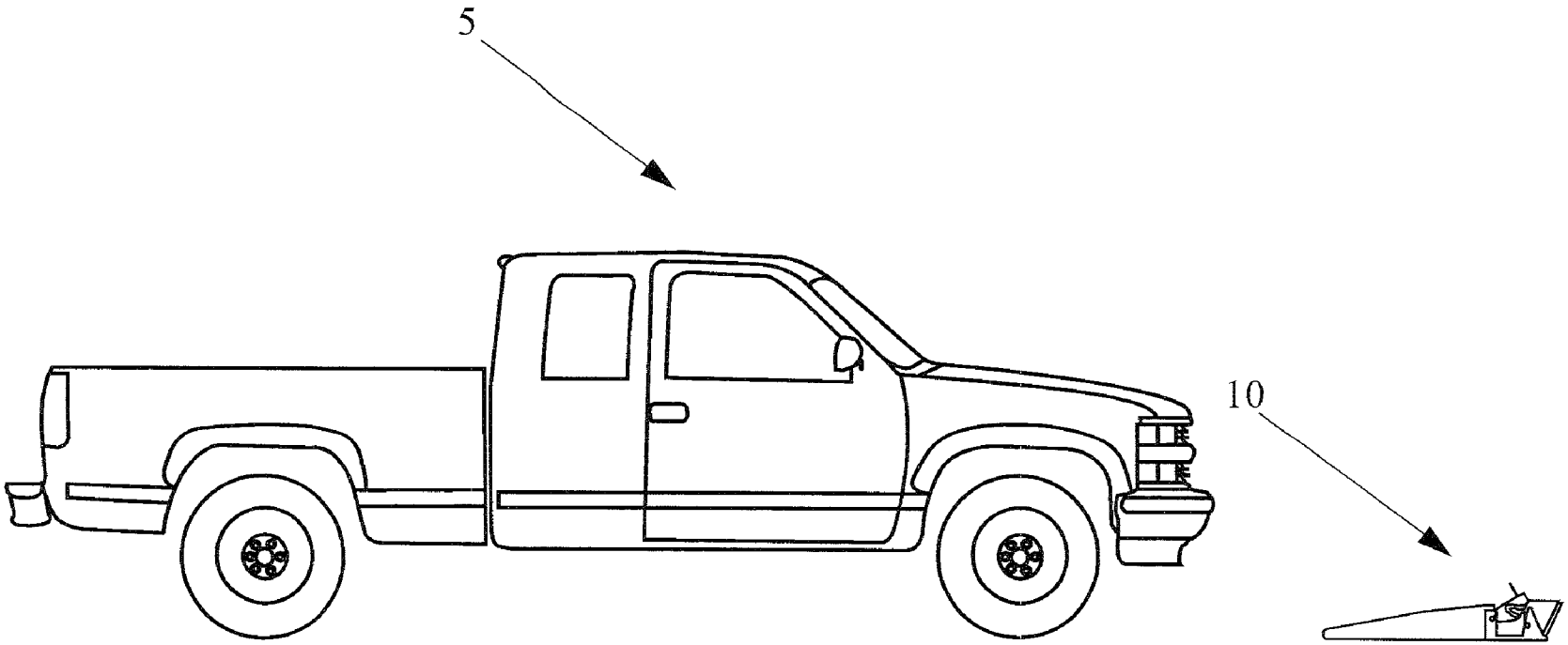
FIG. 3 is an illustration of a pickup truck that shows the truck advancing on the TREAD but the TREAD has been activated so that the cover is open and it is now in "spikes exposed" position.
Figure 4:
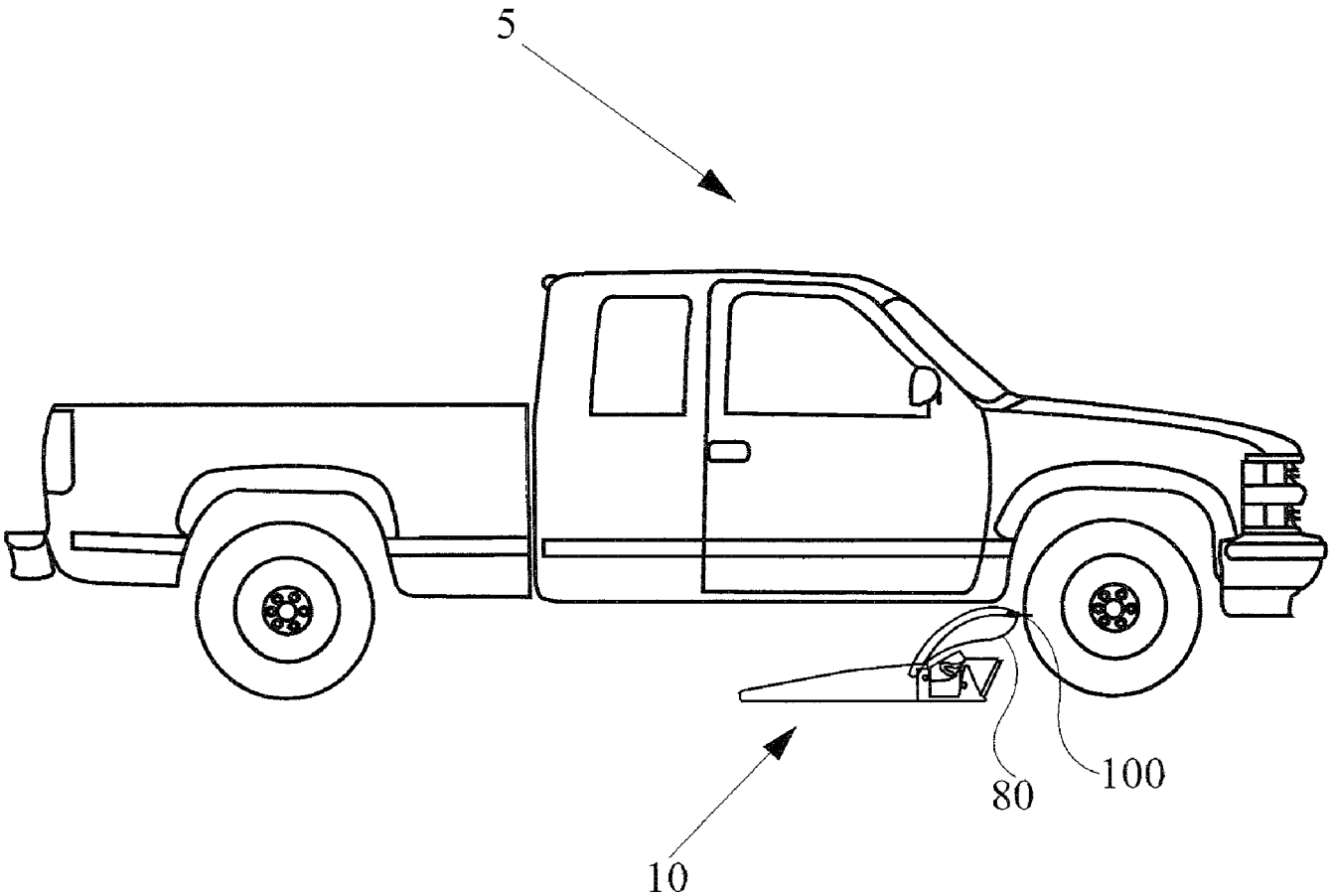
FIG. 4 is an illustration of a pickup truck taken at a point after the truck has traversed the TREAD and spikes have pierced the front tire and the net attached to the spike is being drawn out of the TREAD net storage cavity.
Figure 5:
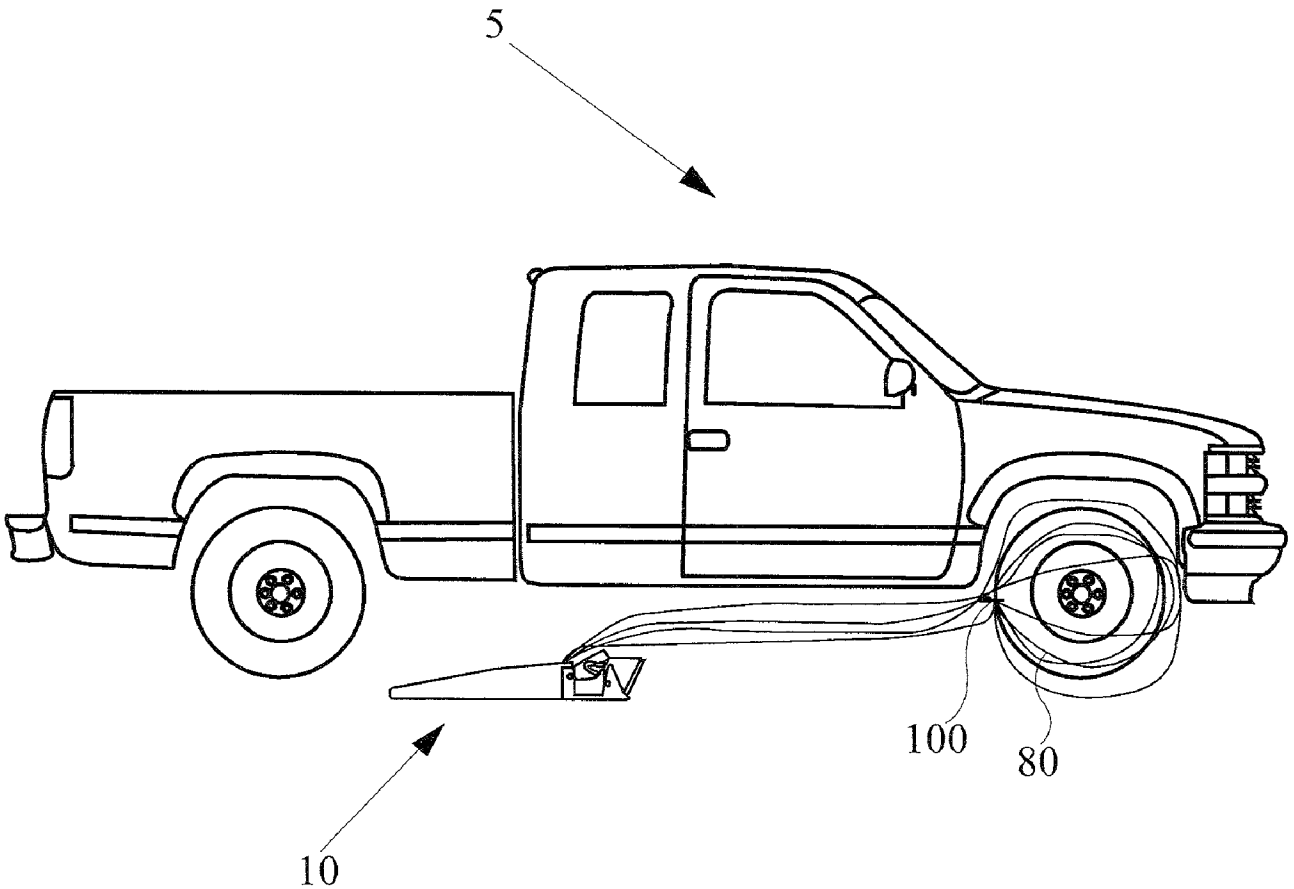
FIG. 5 shows the net entangling the tire after one or more tire rotations.

Particular attention is directed to FIGS. 2-5 wherein a series of illustrations shows how this specific embodiment of the invention functions. FIG. 2 shows a pickup truck approaching the TREAD with the ramp portion facing the truck, and the housing closed and covering the spikes. FIG. 3 shows the truck advancing on the TREAD but the TREAD has been activated so that it is now in "spikes up" position. FIG. 4 is taken at a point after the truck has traversed the TREAD and spikes have pierced the front tire and the net attached to the spike is being drawn out of the TREAD net storage cavity. FIG. 5 shows the net entangling the tire after one or more tire rotations. The effect on the vehicle at this point is as if a full front tire braking force were immediately applied. Additionally, there is no longer an ability to steer the vehicle from its initial path of travel. The system is designed to minimize vehicle damage, allowing rapid clearing of the roadway after the vehicle has been brought to a stop.

The TREAD deployment system is specifically designed to address the selectivity requirement for traffic stop scenarios—i.e. some vehicles should be allowed to pass, while others must be stopped. The modular speed-bump/net deployment design is unique and has several advantages over existing systems:

1) It is rapidly armed from a remote location. This allows arming ("ARM") remotely, if necessary through the use of a remote-controlled camera or even through an internet-camera connection.
2) It has reversible ARM/Safe modes. Physical response of actuation of the TREAD can be less than one second.
3) It may be deployed in either unarmed-by-default or armed-by-default modes.
4) The speed-bump version has a built-in dual use: its design slows traffic in the unarmed state (i.e. acts as a speed bump).
5) The use of a cartridge-net system allows the housing to be reused and quickly reloaded with a new disposable net.
6) It safely and effectively disables a wide range of sizes and classes of vehicles from small cars to tractor-trailers.

The modular design of the TREAD permits compact packaging for transport. In a preferred embodiment the TREAD consists of four deployment modules containing tire spikes supported by a vertically movable spike platform. Each module is approximately 4.5 feet wide, 2 feet long and 4.5 inches in height, weighs approximately 120 lbs, and is equipped with handles for ease of transport. Each module has its own motor with receiver so that it may be controlled individually. In multi-unit modules all motor-receiver units can be set to the same frequency, or interconnected so that their response to an electronic command is simultaneous and identical.

Figure 26:
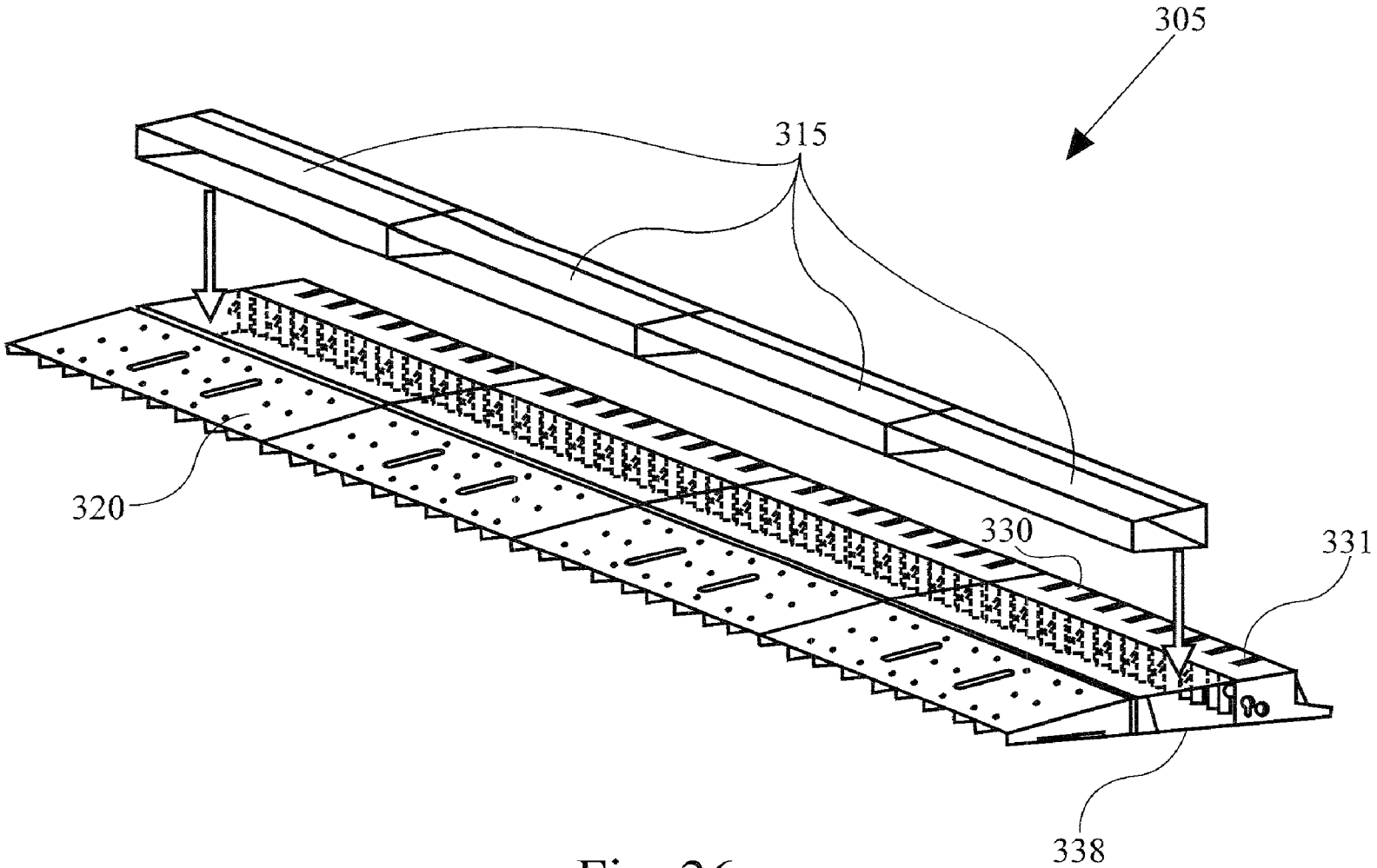
FIG. 26 is a front elevational view of four attached sections of the fourth preferred embodiment, with net cartridges shown about to be dropped into position.

Individual housing modules such as shown in FIGS. 1, 11, 13 and 17 are linked together at their side sheet metal walls by use of conventional means such as nuts and bolts or preformed pockets and tabs. They operate independently, so their interconnectivity is to physically stabilize them once in place on the ground. Once the housings are in place and connected, they are ready to be loaded with a net cartridge. There are two possibilities: a single net or multiple individual nets. If it is a single net spanning all or most of the units, the net cartridge can be as simple as a canvas duffle-like bag with handles for carrying the net rolled or folded up and contained within it. It could also be a hardened carrying case similar to a suitcase that may clip into the housing cavity. If the embodiment contemplates individual net components for each unit, then for a single traffic lane multiple nets each contained in an individual housing unit as shown in FIG. 26 would have to be spliced together at their peripheries through a series of connecting linkers such as a carabiner. Other means of connecting the nets by splicing them together with rope or cable will be apparent to one of ordinary skill in the art. In this embodiment, after the nets and connectors are loaded they will have to be manually connected so that when deployed they all act in concert as a single net would.

In one embodiment the TREAD is designed to operate as a traffic speed control device in its unarmed state. By shaping the housing in the form of a speed bump, approaching traffic will be slowed at the traffic checkpoint in a fashion similar to that of a standard speed bump (though it is also possible to recess the TREAD within the road surface to present a lower profile to oncoming traffic).

In the single-net embodiment designed for four modules to contain a single net, a single net cartridge spans the width of the four TREAD modules which is sufficient to control a single lane of traffic. Alternate embodiments may have practically any number of modules per traffic lane, the only limiting factor being the length of the module in relation to the width of the traffic lane to be covered. The cartridge can be folded to allow transport by one person. The replaceable cartridge system allows quick initial deployment while assuring and maintaining the proper net fold pattern and positioning within the housings. The correct net fold pattern is important due to the high velocity at which the net can be deployed from the housing. The unique cartridge system has been designed to provide spike connection during the arming process, minimizing initial deployment time. In an individual net embodiment of the invention, individual nets fit within each module but may be synchronously controlled for deployment.

In one embodiment arming controls for the TREAD consist of a remote hand-held electronic enclosure with an arming toggle and an indicator light for TREAD status. Each TREAD module is actuated by a single electric motor that is selected for extended performance in hot, cold, dusty, wet and sandy environments. A protective housing door or cover allows vehicles to safely pass over the spikes in the unarmed state. When the TREAD is armed, the housing doors rotate or flip back and the spikes rise to the armed/exposed position.

Once the operator presses the remote ARM trigger, the TREAD is active and exposes the series of spikes or staples in less then one second. The TREAD can be set in either "normally open" or "normally closed" default states, with manual control of the default state change. This allows operators to either actively arm the system or actively disarm the system, depending on the threat environment at the checkpoint location. In the armed configuration, the net will engage and entangle the next wheeled vehicle that attempts to cross the TREAD. In order to allow the clearance of the disabled vehicle out of the checkpoint area (TREAD deployment area), the TREAD net can be removed from the target vehicle. It has been the inventor's experience that the net can be removed in approximately 10 minutes using the proper tools. Because of the material strength, the net is not easily cut with conventional knives; however, it can be cut using specialized scissors or a hot-knife. Specialized handheld cutting devices are provided as part of the TREAD tool kit. Once the net is removed, the target vehicle can be driven over short distances under its own power—likely with two flat tires. In prototype testing of the system, the vehicle sustained tire damage but no significant body or mechanical damage during the arresting process. Several usage scenarios are possible with the TREAD system including laying multiple units end to end to control the flow of multiple traffic lanes and laying multiple rows of tread systems across a road lane so that several vehicles in series could be stopped before reloading the TREAD housings with new cartridges.

The following embodiments are illustrations of the inventions discussed herein, and should not be applied so as to limit the appended claims in any manner.

2. Detailed Description

Figure 1:
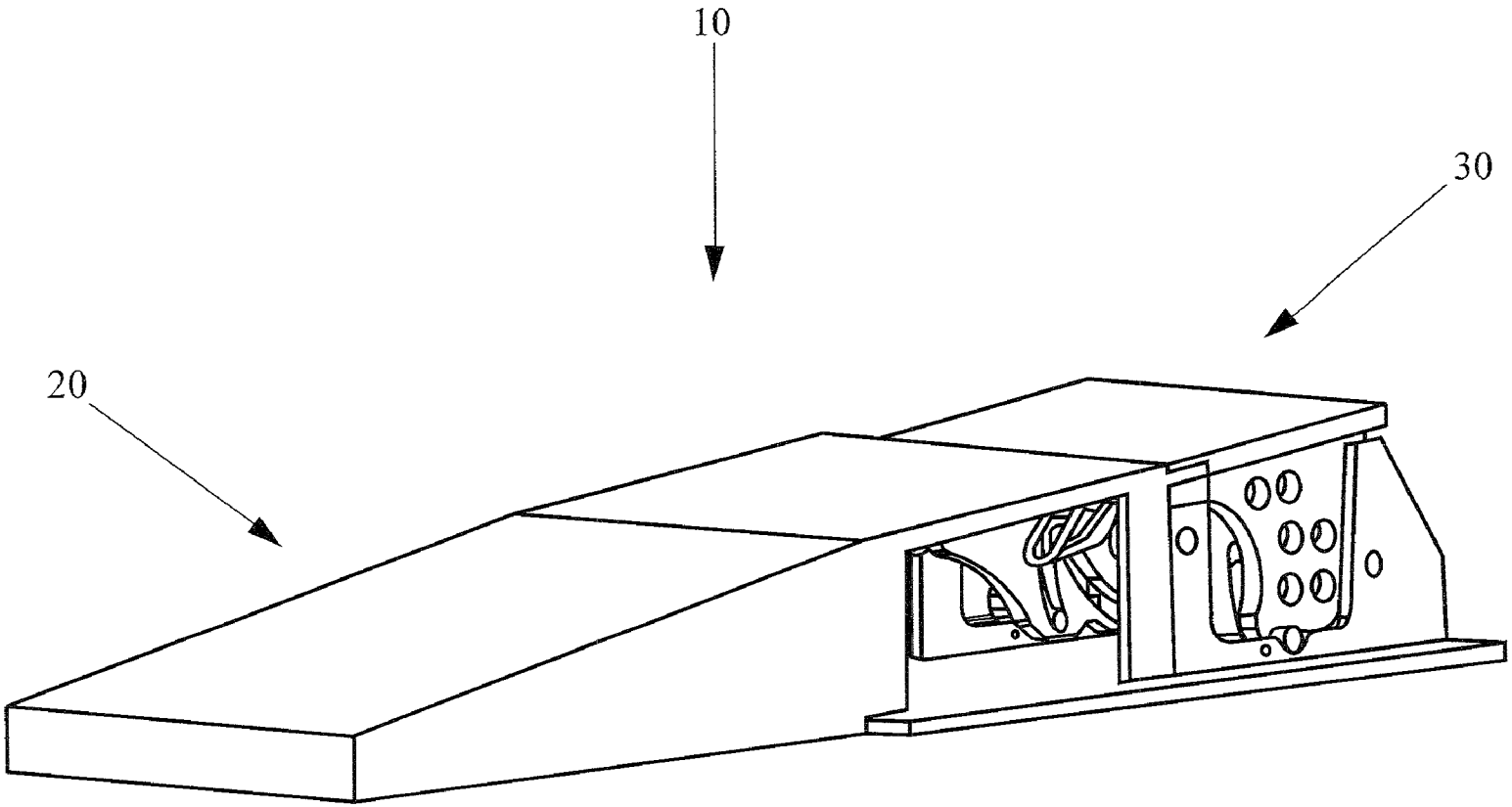
FIG. 1 is a schematic of a first embodiment of a single section of the Tire Rapid Entanglement and Arresting Device ("TREAD") with ramp in place and cover closed.

A first embodiment of the invention will now be introduced. With attention directed to FIG. 1, vehicle capture device 10 includes a ramp 20 and a housing 30 that contains all of the working features of the device. Ramp 20 faces oncoming traffic, and may be detachable as shown. The ramp is of conventional design and is intended to serve as an interface between the road and the housing so that a vehicle will climb the ramp to pass over the housing. In a preferred embodiment device 10 is designed to function as a speed-bump, thereby having a second function to slow the traffic through the checkpoint area. This first embodiment has the TREAD net housed in a portable module consisting of four (4) 54-inch sections linked together to create an 18-foot wide speed bump-like device as shown in FIG. 26. FIG. 1 depicts a single module of a multi-module group.

Figure 6:
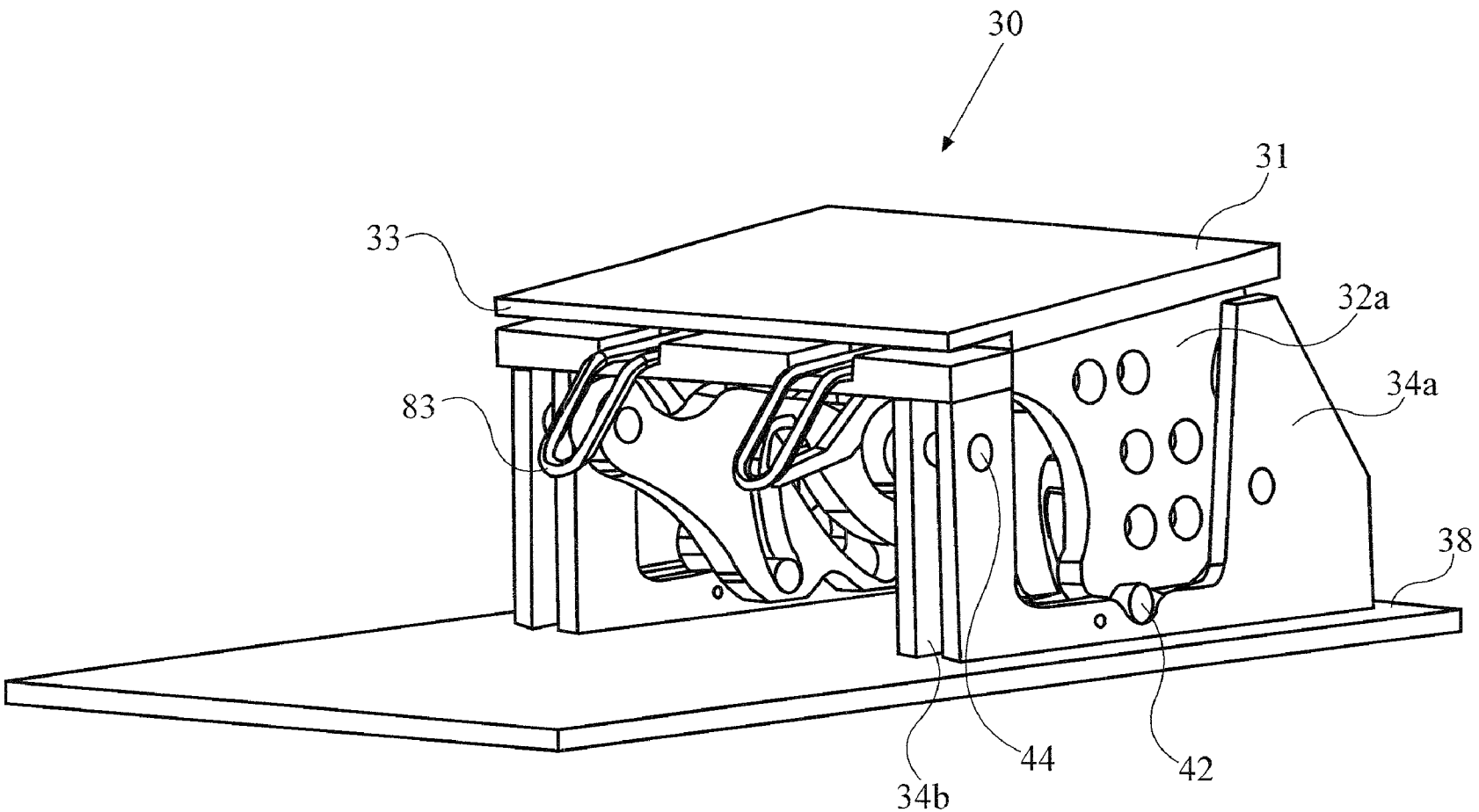
FIG. 6 is an elevational perspective of a line drawing of the housing without the ramp so that the interior is visible from the front right corner angle.

FIG. 1 shows the device in the first position, that is, with the housing cover 31 (see FIG. 6) down and the spikes hidden beneath the cover. FIG. 6 shows the housing 30 still in the closed position, but without the ramp 30 or cartridge storage area attached to it. Housing 30 comprises a base 38 upon which all other components are directly or indirectly anchored. The base also serves to provide a substantial weight so that as vehicles drive over it the housing will not deflect or be easily moved. The base may be made from a conventional rigid material such as steel or aluminum. Housing cover 31 serves as the top portion of the ramp, and also as the cover for the spikes when in the closed position. Housing cover 31 has two cover brackets attached to it, right cover bracket 32*a* and left cover bracket 32*b* (see FIG. 8). The brackets serve to provide support for the housing cover 31 above, and also interface with the cover bracket supports 34*a* and 34*b*, which are attached to base 38. The brackets are driven up and down by motor 50 through drive gear 51 and gear or teeth 53 (see FIGS. 7-9) thereby raising and lowering it. The speed of arming is typically less than 1 second. A gear or teeth 53 are attached to or machined into either or both right or left cover brackets 32*a*, 32*b* which gear or teeth 53 mesh with drive gear 51 and thereby power is transferred from the motor to the cover to urge the cover up or down on command.

Figure 8:
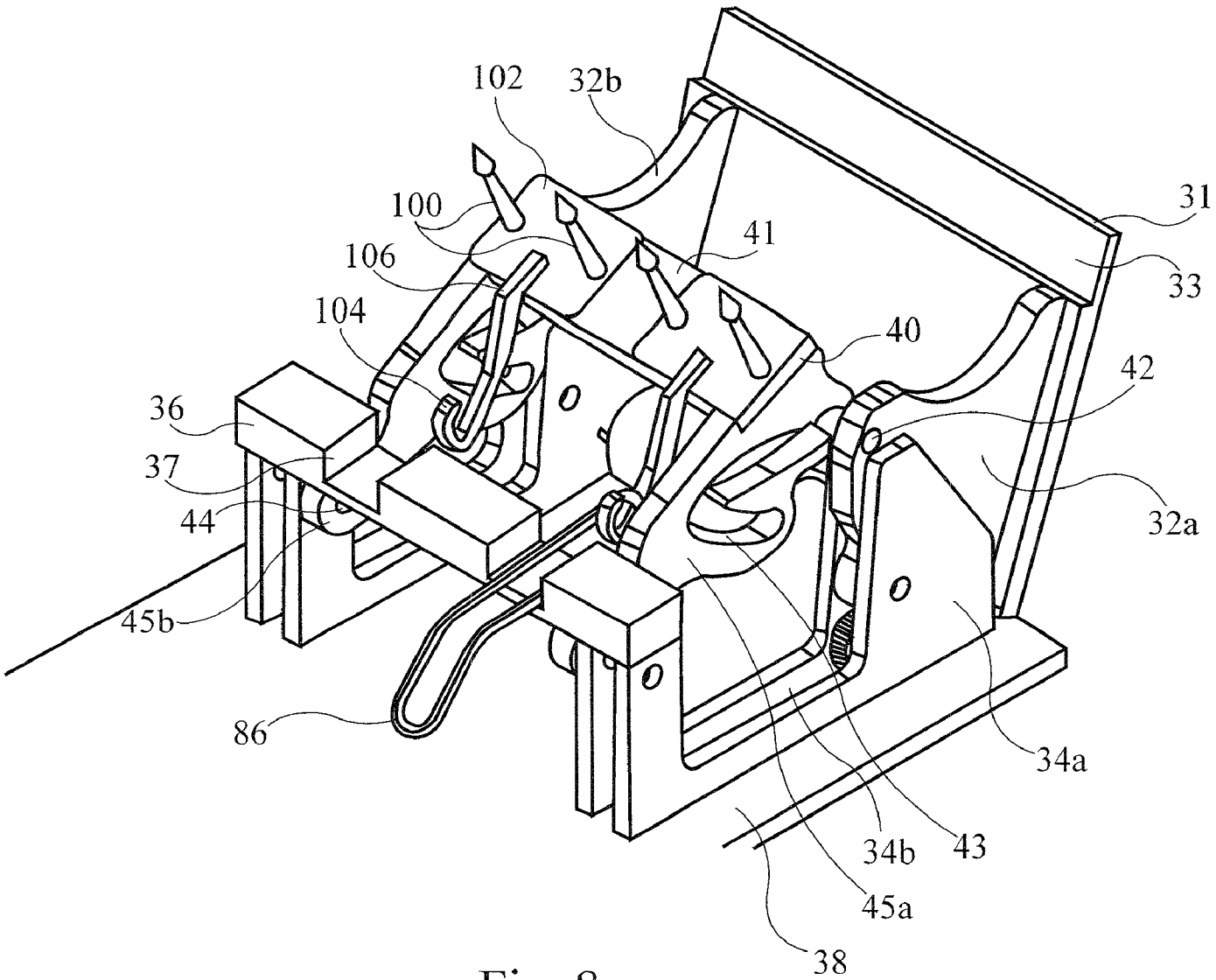
FIG. 8 is an elevational view in gray-scale of an open housing with spikes deployed upwards.
Figure 9:
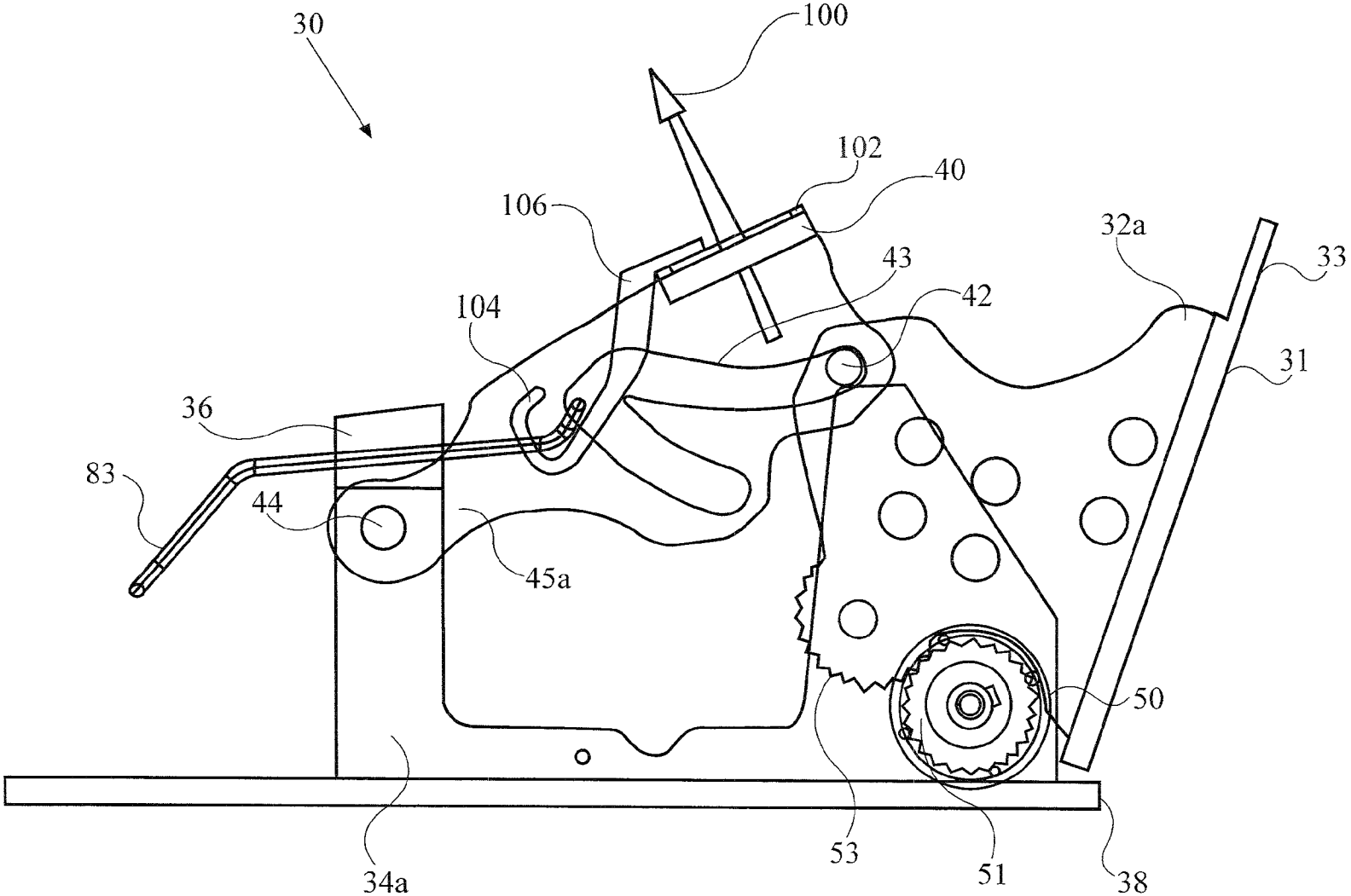
FIG. 9 is a side view line drawing of the housing in the spikes exposed position as shown in FIG. 8 made partially transparent.

FIGS. 8-9 show the housing 30 with the cover 31 open or retracted thereby exposing the spikes to oncoming vehicular traffic. With particular attention to FIG. 8 there is shown an open housing with the spikes in an upright or exposed position. In this figure traffic would normally be coming from the left and would climb the ramp (not shown). The tire would impinge upon the spike 100 which would then be driven through the tire tread of a pneumatic tire and through the tire casing. Given the barbed nature of the spike it will resist being pulled out of the tire. It should be noted that the function of the spike is to attach itself to the moving tire and not to rapidly deflate the tire. The function of the spike is to attach itself to the moving tire and anchor itself strongly enough so that it will pull the net out of the housing, and then around the tire. Thus, any form of anchoring device that satisfies those requirements is considered an equivalent technology hereunder, and would come within the spirit and scope of this invention. For example, a fast-acting glue may also be used to attach the net to the tire. In this particular embodiment, the spikes are arranged in pairs on a spike base 102, which in some ways is similar in design to a staple. Spike base 102 also has the hook arm 106 and hook 104 attached to it. In one embodiment spikes 100, spike base 102, hook arm 106 and hook 104 are one unitary design, although they may be separately made and assembled on the housing through the use of conventional fasteners such as nuts and bolts. The function of the hook is to catch a loop or leader 83 of the net 80 so that as the spike is carried away from the platform by the moving vehicle the hook is the attachment point for the net to the spike base. As best shown in FIG. 8, the spike base 102 is releasably mounted upon the spike ledge 41 which is the portion of the spike platform 40 specifically designed to hold the spikes. "Releasably mounted" means that the spike base will release and be carried off embedded in the tires when the tires roll away from the platform. Alternatively, the spike may also be attached to the net by carefully penetrating the strands of the net with the top of the spike in an area of a loop junction and sliding the net down over the spike shaft so that the loop junction will become sandwiched between the spike base and the tire as the spike penetrates the tire. Numerous other methods of attaching the spikes to the net are possible and all come within the scope of the invention.

Figure 7:
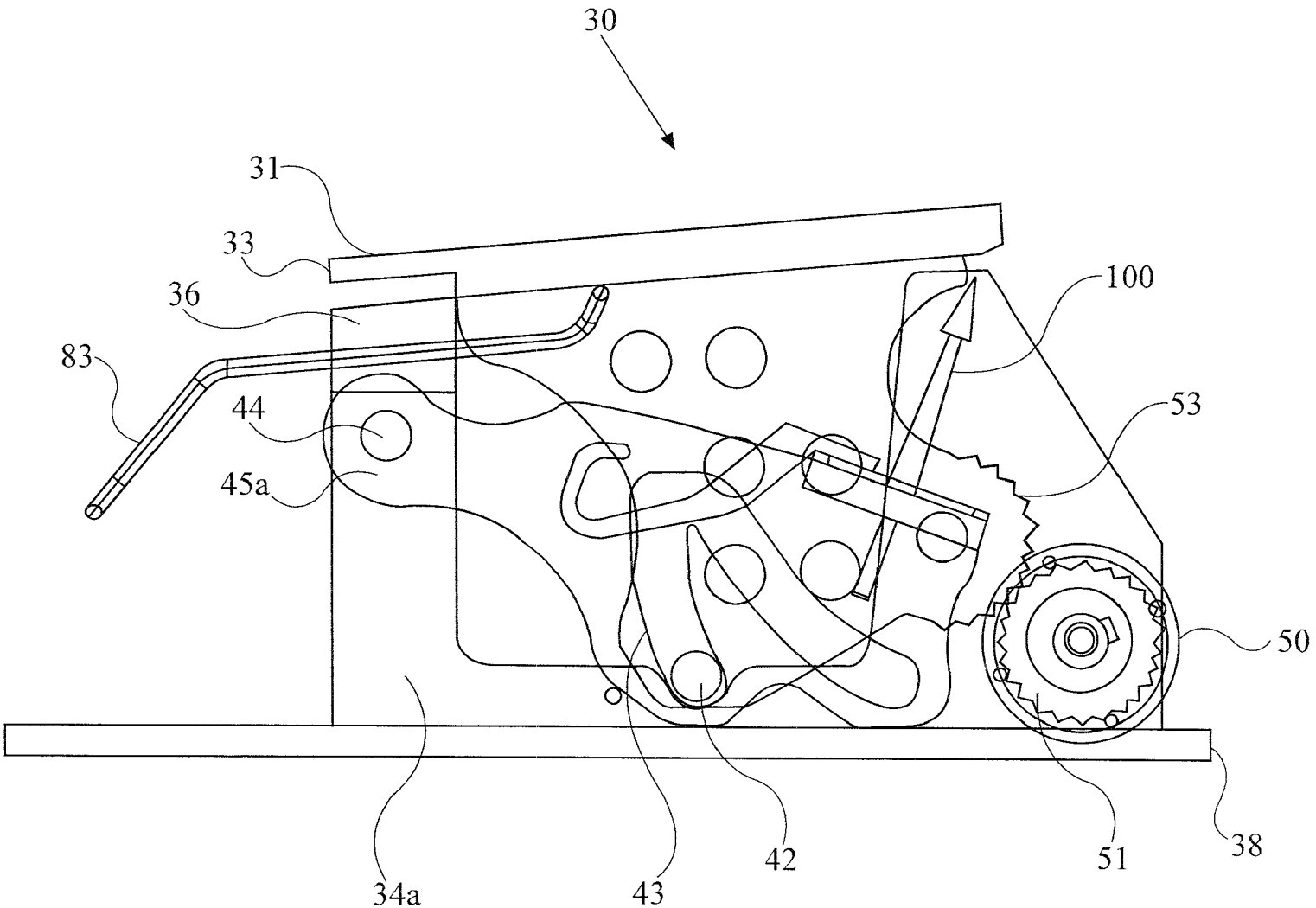
FIG. 7 is a side view line drawing of the housing of FIG. 6 made partially transparent.

Spike platform 40 has two main functions, the first being to provide a support point for the spikes, and the second to move from a position where the spikes are exposed to vehicular traffic (also known as the "open" position) to the second position of having the spikes unexposed or covered ("closed" position). In order to allow for coordinated movement of the spikes and the cover 31, and as shown in FIGS. 7-8 the spike platform 40 and the right and left spike platform arms 45*a*, 45*b* when combined form a unit that transfers up and down motion from the cover 31 to the spike platform 40. FIGS. 8 and 9 show the spike platform arms 45*a*, 45*b* connected to the front of the housing 30 through pin or axle 44 which is pinned through the hole in the inner and outer cover bracket supports 34*a*, 34*b*, respectively. The pins function to allow rotation of the arms 45*a*, 45*b* about the axis defined by the pins. The back of spike platform arms 45*a* and 45*b* have guide cutouts 43 which rest upon spike platform guide pin 42 thereby supporting the rear of the arms. The guide is shown as a cutout or slot but may equally well be a rail- or gear-type guide. As previously discussed, the cover is raised and lowered through the action of the motor 50 through gear 51, and gear or teeth 53. FIGS. 6 and 7 show the cover down and the spike platform arms and associated spike platform in the lowered position. As the motor 50 is activated to open the cover 31, it directly drives the cover up through gear 51 and gear or teeth 53 located on cover brackets 32*a* and/or 32*b* which in turn drives spike platform guide pin 42 vertically through the cutout 43 unopposed for a distance until the pin encounters the corner of the cutout, at which point it urges the spike platform 40 upwards as the pin continues to move vertically. In FIGS. 8 and 9 the cover is shown in its fully opened position with the spike platform fully exposed and ready to contact passing tires. In the closed position cover lip 33 contacts cover bracket support tie bar 36. Cover bracket support tie bar 36 functions to provide lateral and vertical support to the cover bracket supports 34, and also functions as a "rest" for the net loops 83.

The housing may be adapted to support two forms of the device, depending upon whether the spikes are integral with the net, or are separately stored in the housing until such time as the net is loaded into the net cavity of the housing. The embodiment shown immediately above presumes the spikes are separate from the net. This is preferred for safety reasons because the net cartridge will not contain the spikes and so its handling and transport will be significantly less dangerous. Other embodiments of the invention may include the spikes being integral with the net, but protected by covers that would be removed upon completion of loading of the net into the housing. Anchoring the spikes to the leading portion of the net could be accomplished in numerous ways, for example the spikes could be simply threaded through the individual strands of the net. Another way to anchor the spikes is to form two or more holes in the spike base and then attach the net cells through the holes in the spike base. Yet a third way is to form a grommet or hole in the net itself which would then be looped over the spike One of ordinary skill will be able to create any number of different ways to accomplish the result of attaching the spikes to the net, all of which come within the spirit and scope of the present invention.

Figure 11:
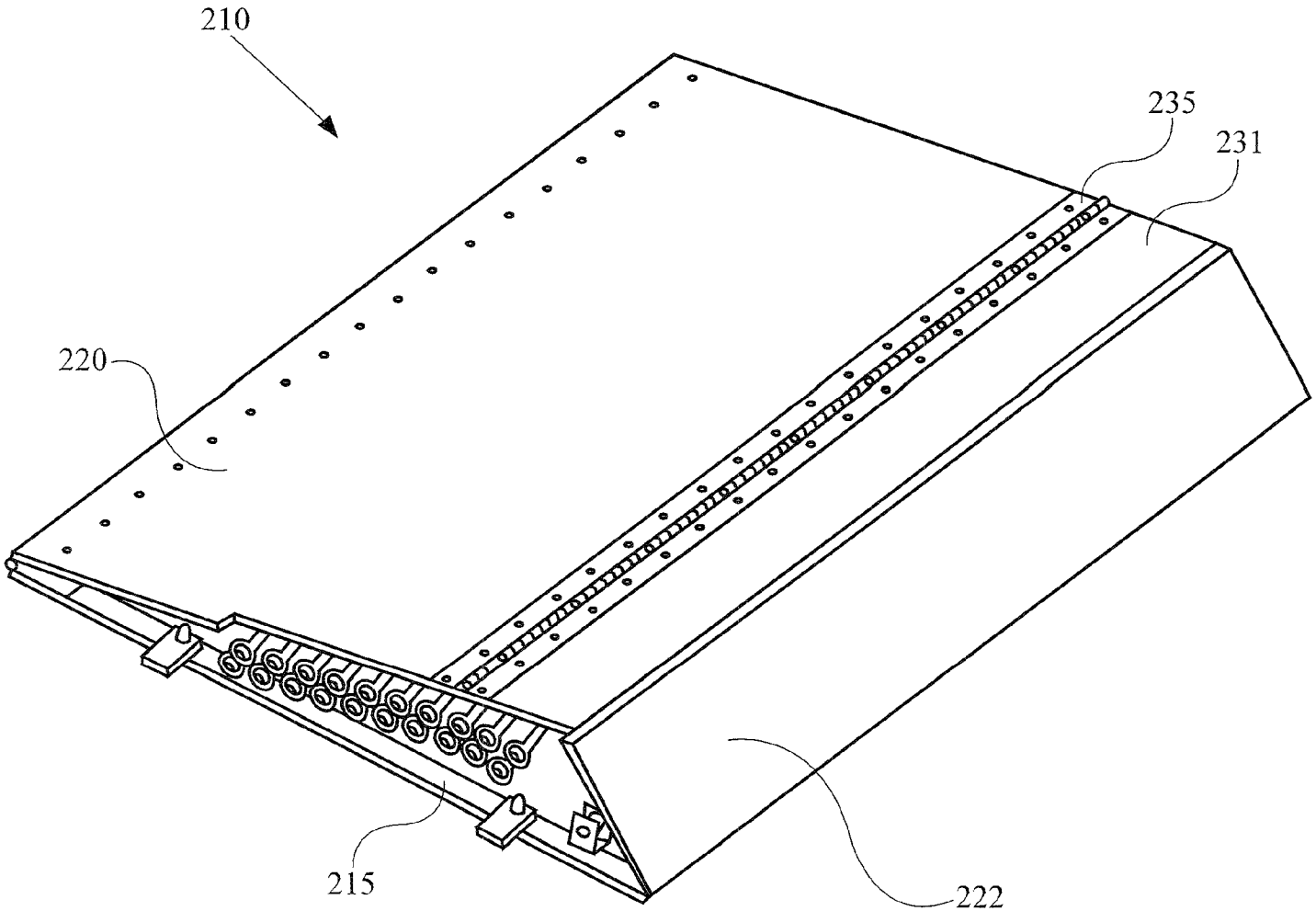
FIG. 11 is a gray-scale perspective view of the second embodiment of the invention in the closed position.
Figure 12:
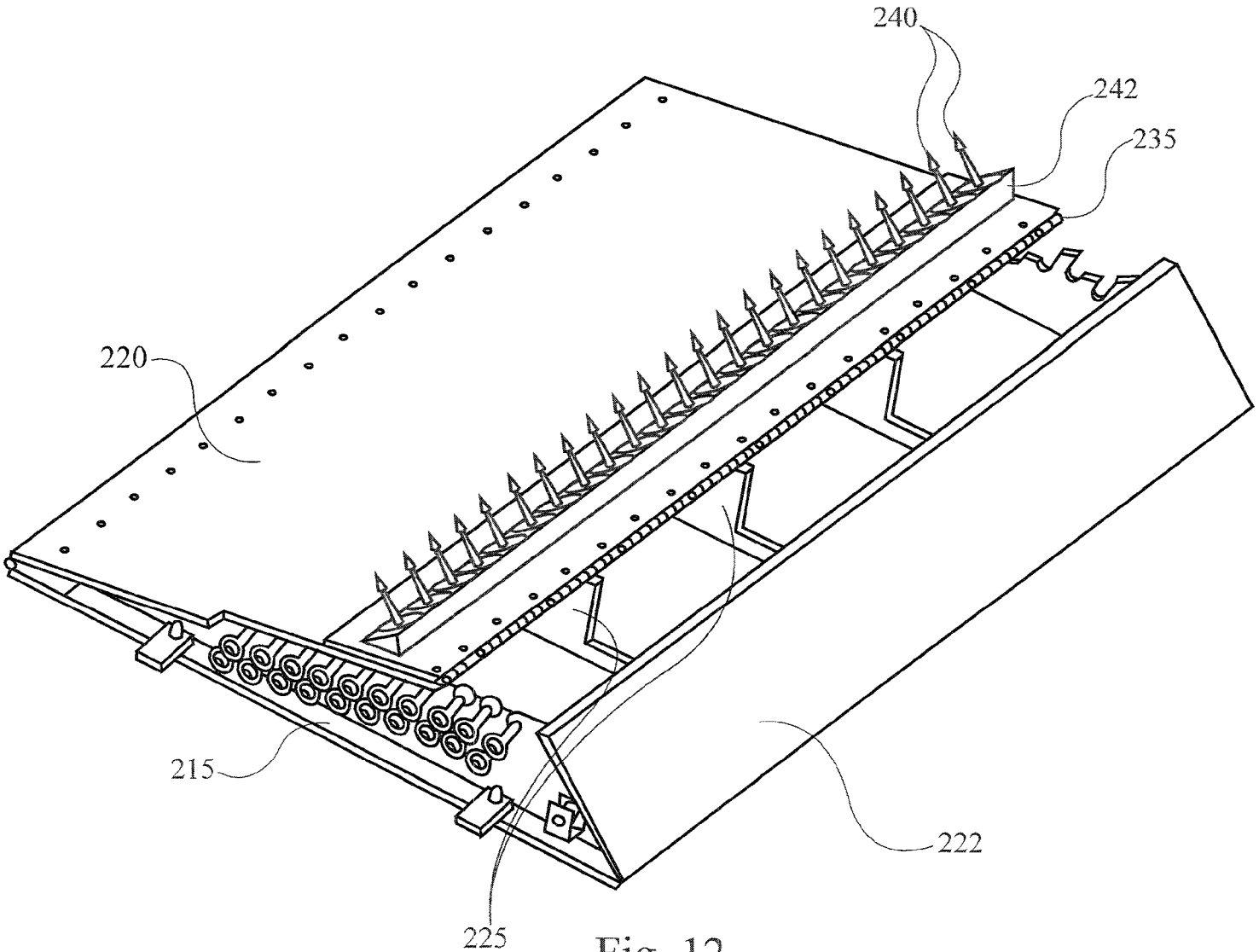
FIG. 12 is a gray-scale perspective view of the second embodiment of the invention in the open or "spikes exposed" position.

A second preferred embodiment of the invention is embodied by FIGS. 11 and 12. FIG. 11 shows a single section of a closed vehicle capture device 210 comprising a base 215, an up ramp 220, an internal ramp hinge 224 located at the leading edge of the ramp, a cover hinge 235 and cover 231, and a down ramp 222. The embodiment is a unitary ramp and housing design, unlike the previous embodiment where the housing and ramp are physically distinct. In actual usage the up ramp 220 is so named for the oncoming traffic that first climbs this part of the ramp-and-housing combination. FIG. 12 shows the vehicle capture device in an open configuration wherein the spikes are exposed to a selected vehicle. Cover 231 is flipped back to expose the spikes 240 arrayed along the inside of the cover. Spikes 240 are supported on spike support 242, which is in turn attached to the cover by an adhesive with release capabilities. The up ramp is supported by ramp supports 225 partially visible inside the up ramp. As in the previous embodiment, the net (not shown) is stored within the vehicle capture device and when a tire is punctured by the spikes, the spikes release from the cover and drag the net out of the device and enwrap the tires as previously described. An actuating device such as a motor (not shown) and gearing are required to automatically flip the cover, although it can be manually flipped without the actuator.

Figure 13:
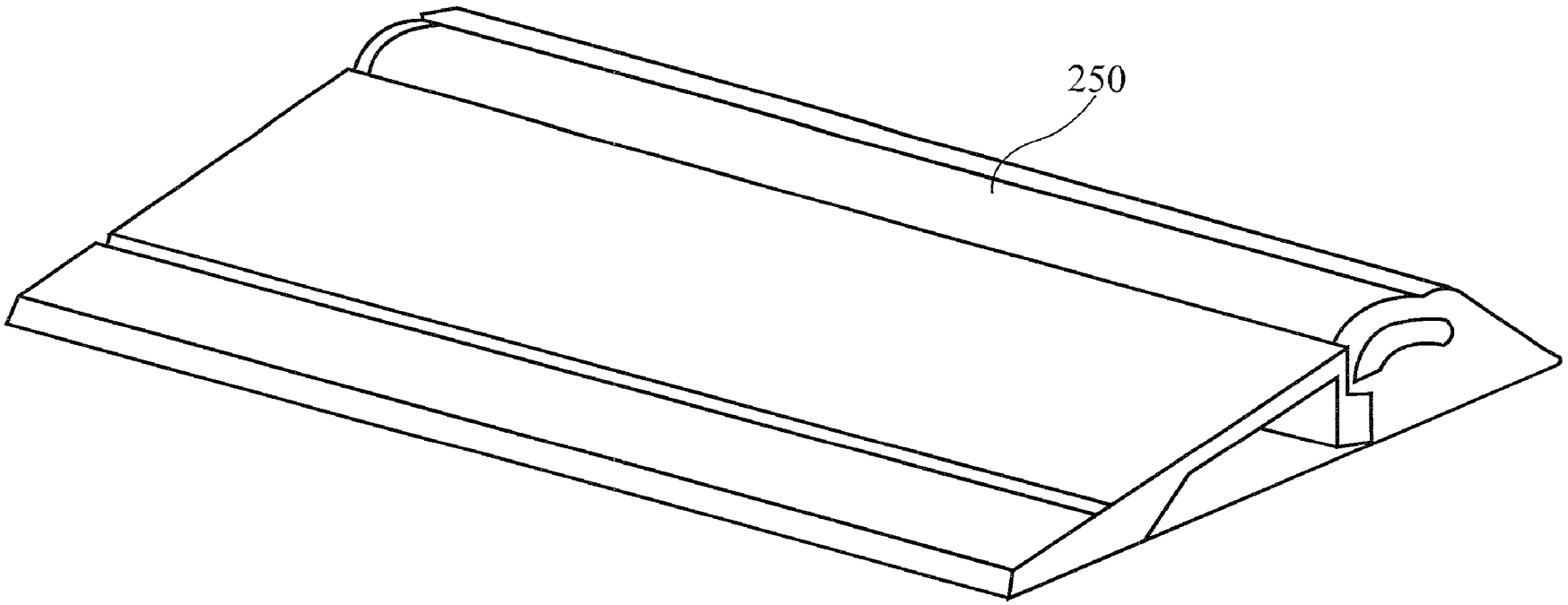
FIG. 13 is a gray-scale perspective drawing of a third embodiment of the invention in the closed position.
Figure 14:
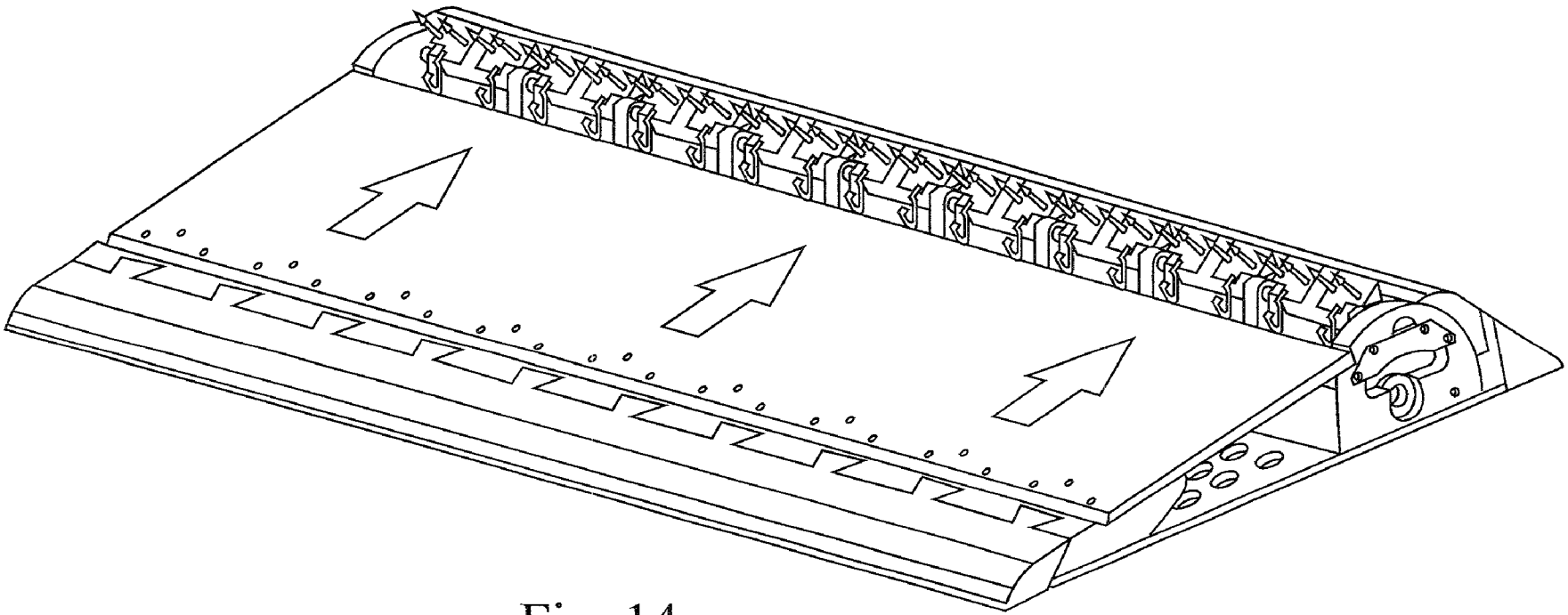
FIG. 14 is a gray-scale perspective drawing of a third embodiment of the invention in the open position.
Figure 17:
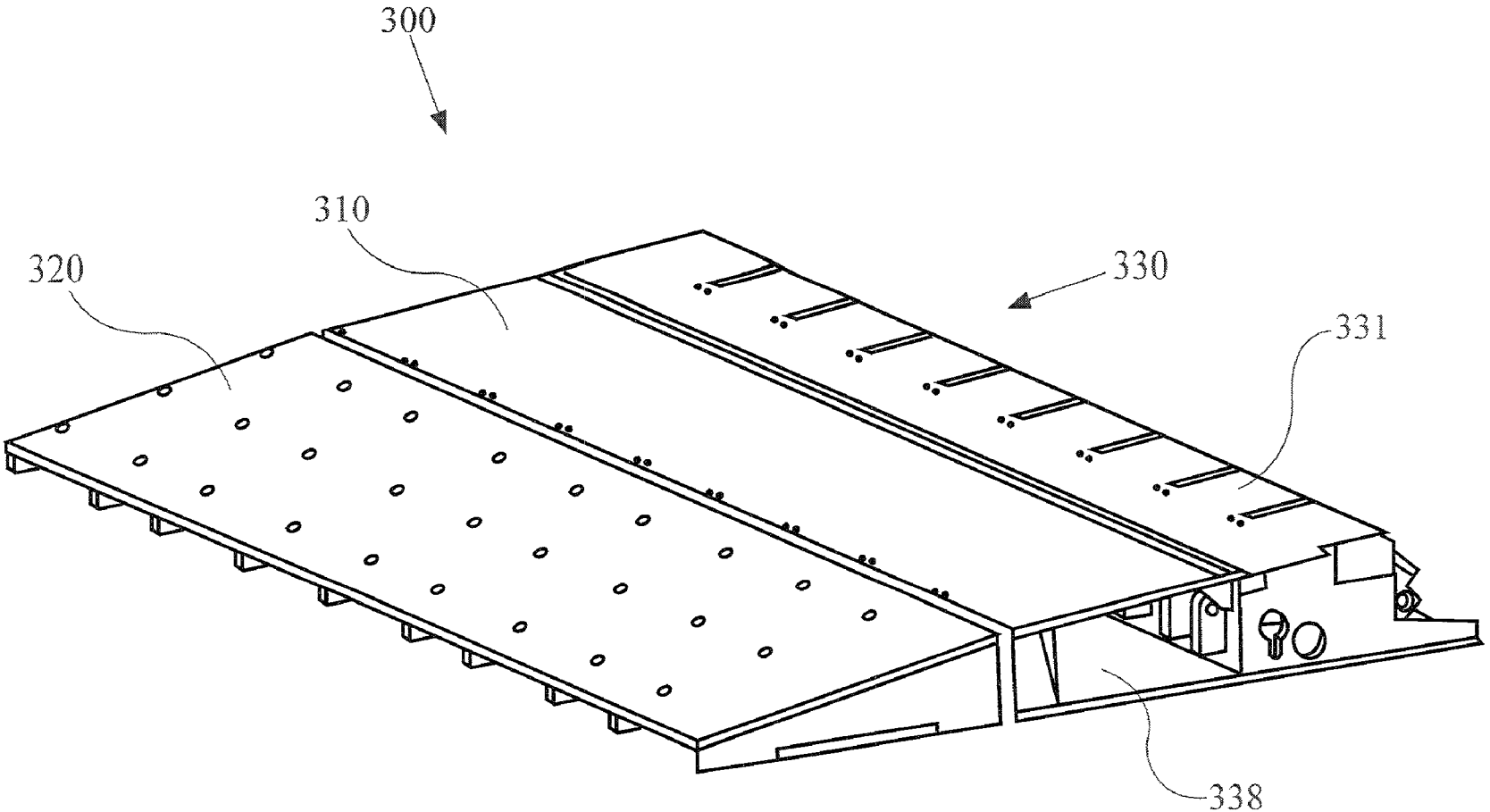
FIG. 17 is a front-view gray-scale elevational drawing of a single section of the fourth preferred embodiment of the invention in the closed position.
Figure 18:
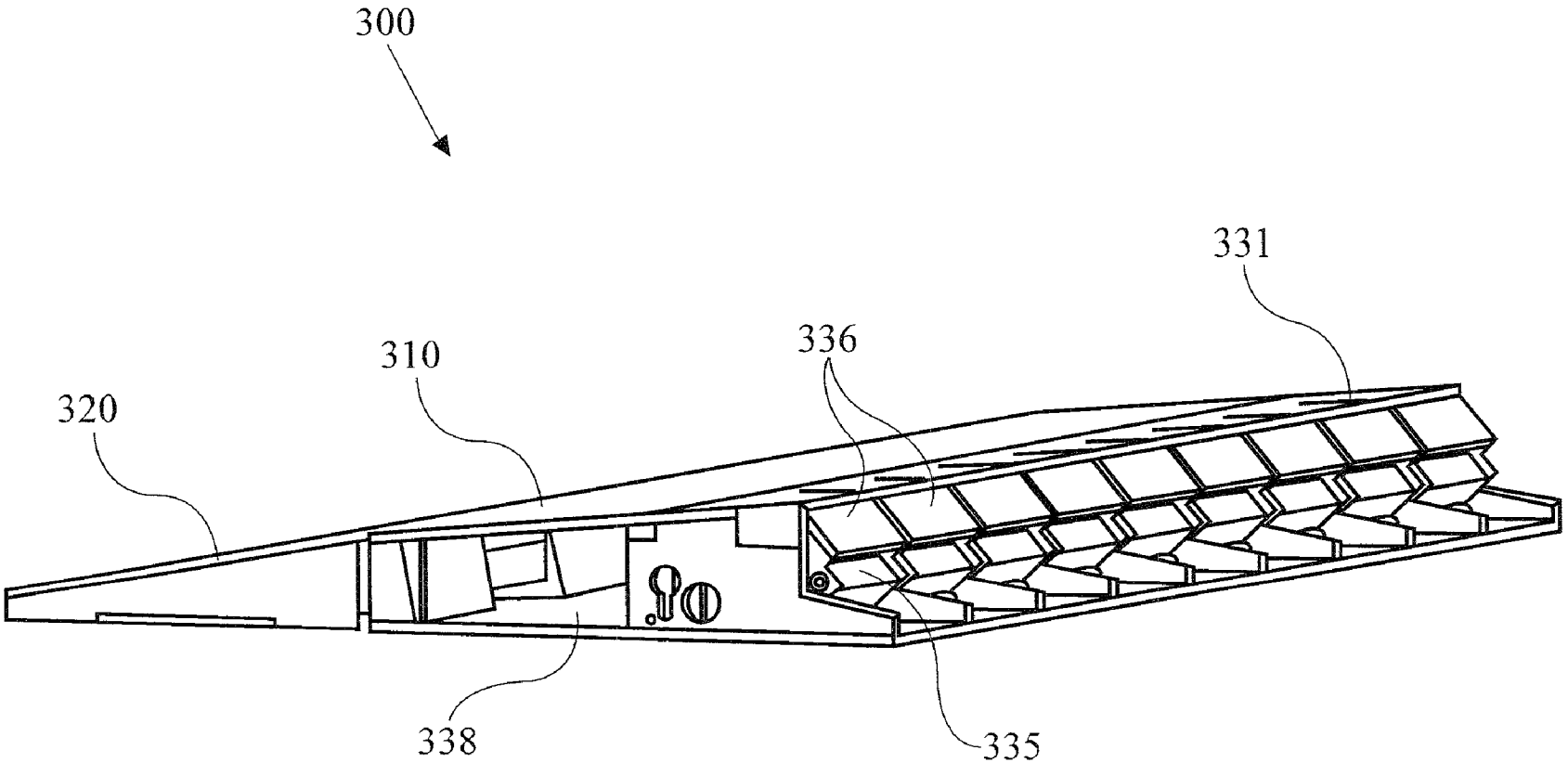
FIG. 18 is a rear-view gray-scale elevational drawing of a single section of the fourth preferred embodiment of the invention in the closed position.
Figure 19:
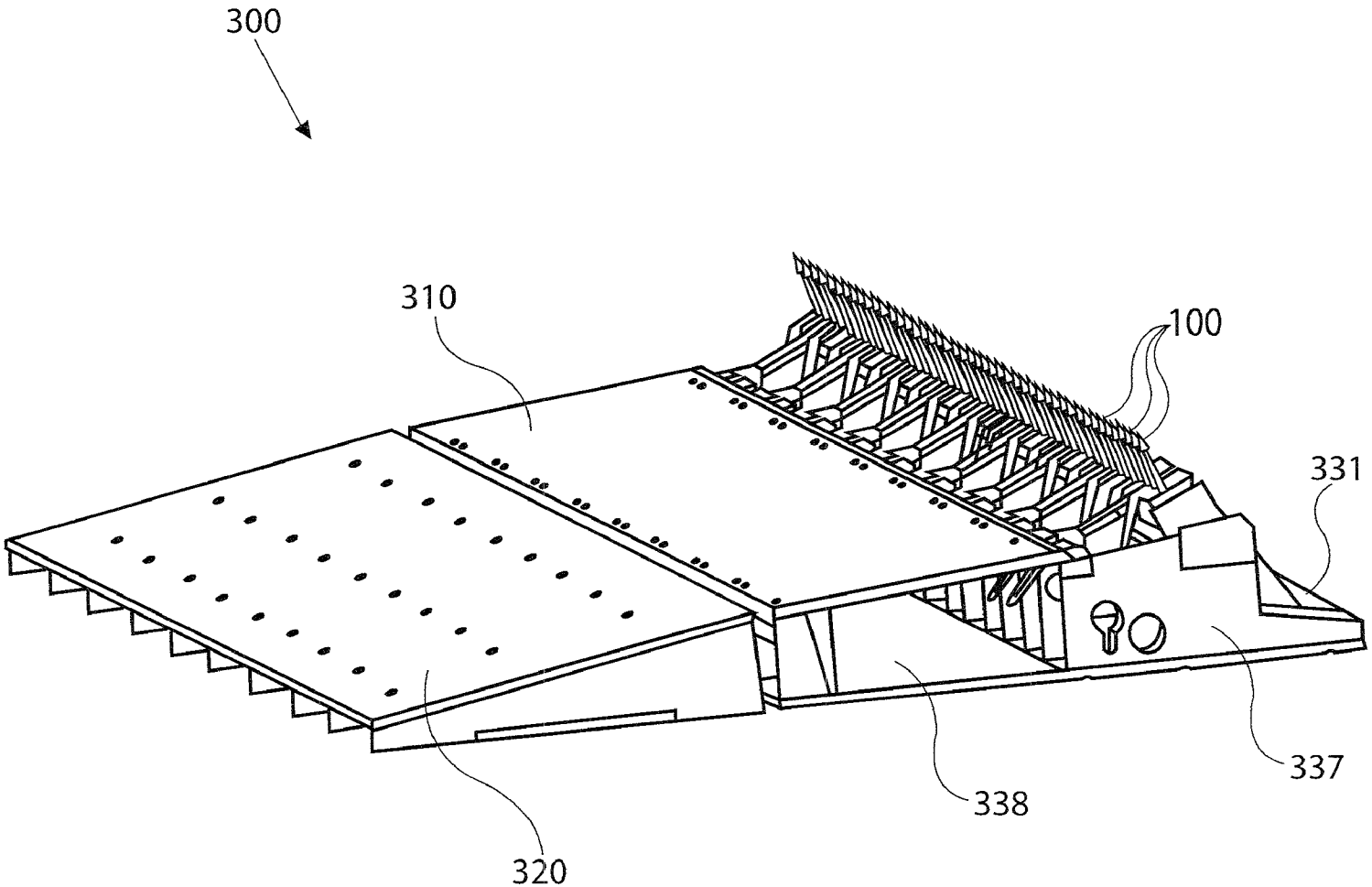
FIG. 19 is a front-view gray-scale elevational drawing of a single section of the fourth preferred embodiment of the invention in the open position.
Figure 20:
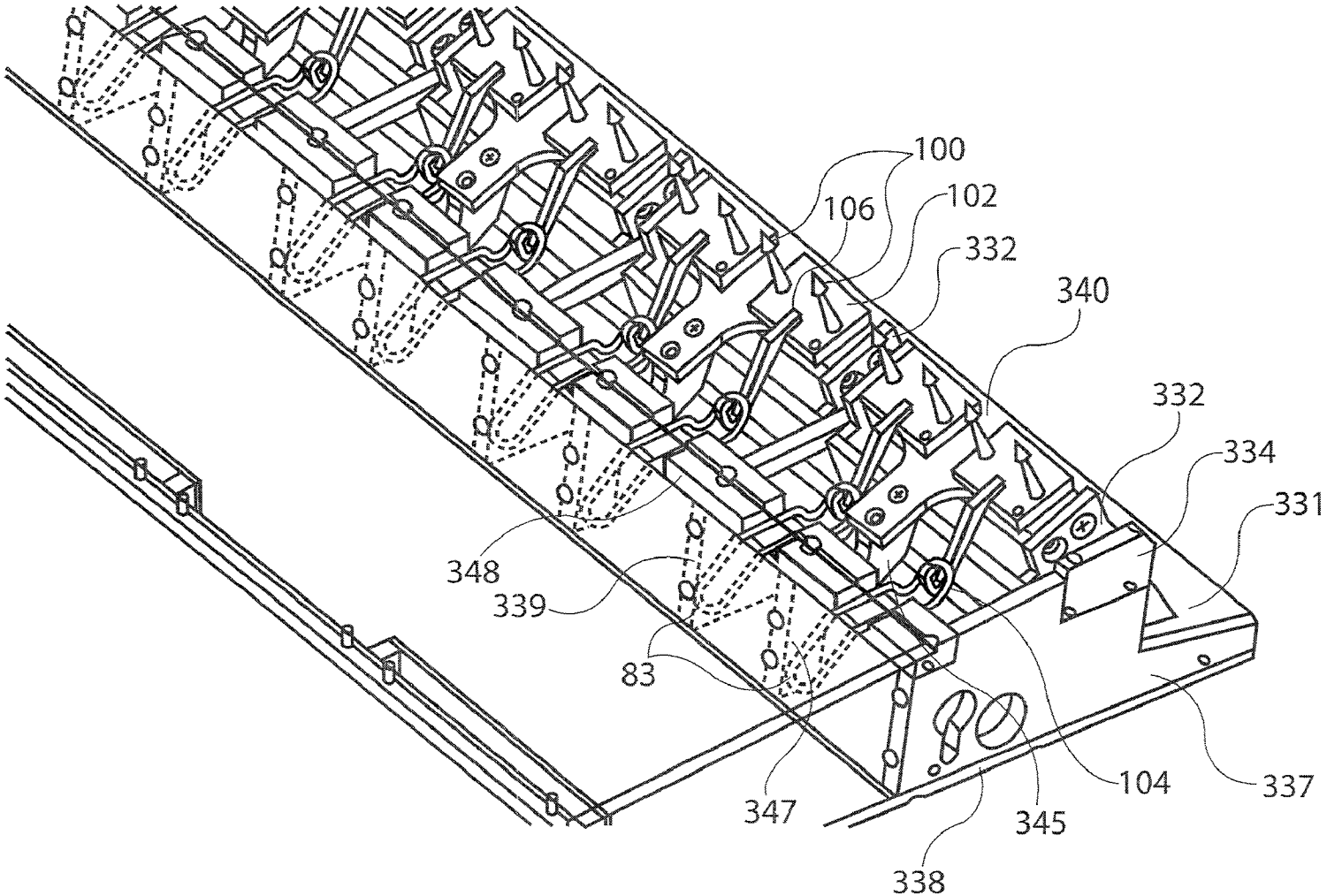
FIG. 20 is a front elevational view of a portion of a single section of the fourth embodiment in the open or spikes raised position with the cavity cover made transparent.
Figure 21:
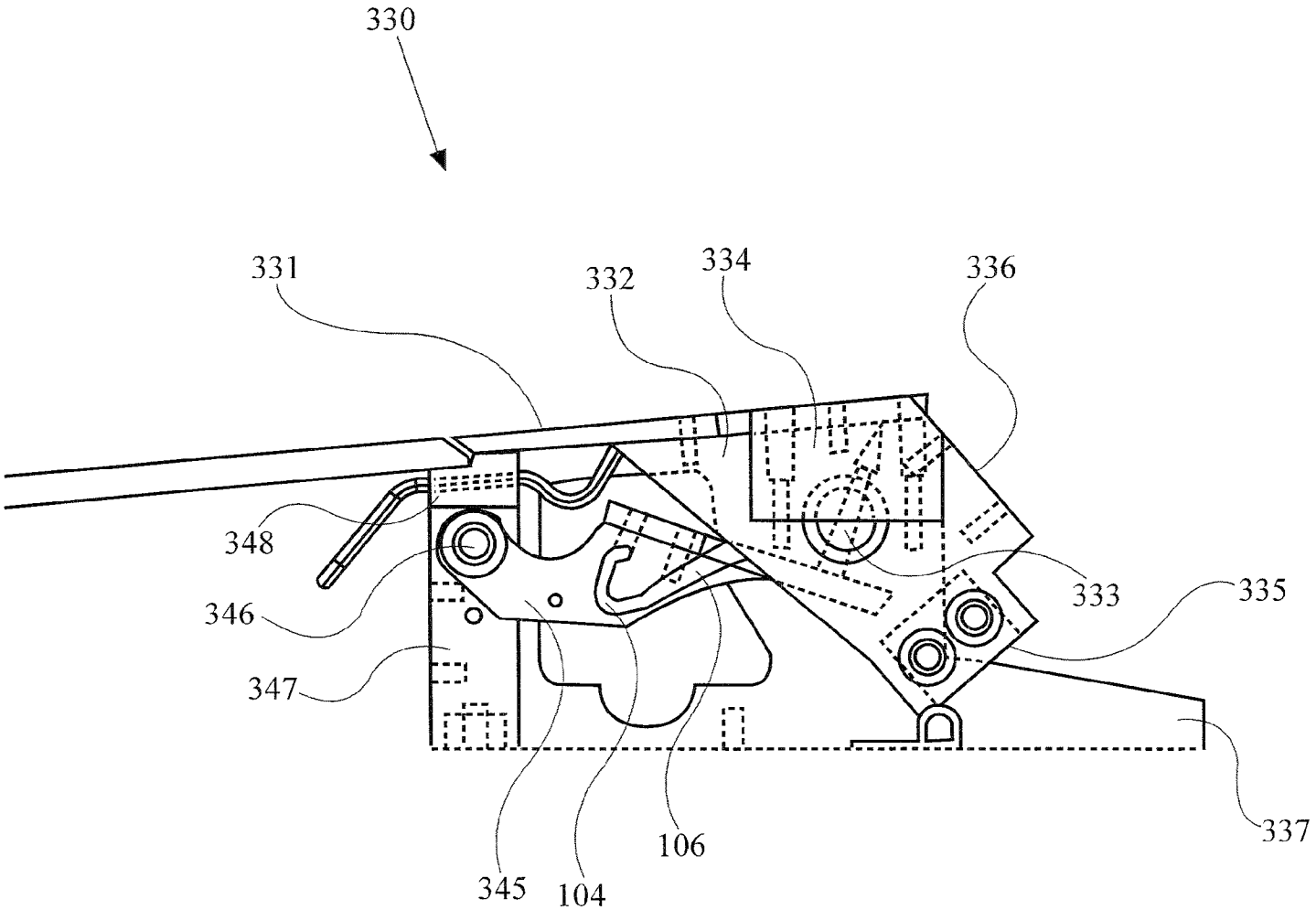
FIG. 21 is a line drawing, side view of one bay, partially transparent, with housing cover closed and the cavity cover closed.
Figure 22:
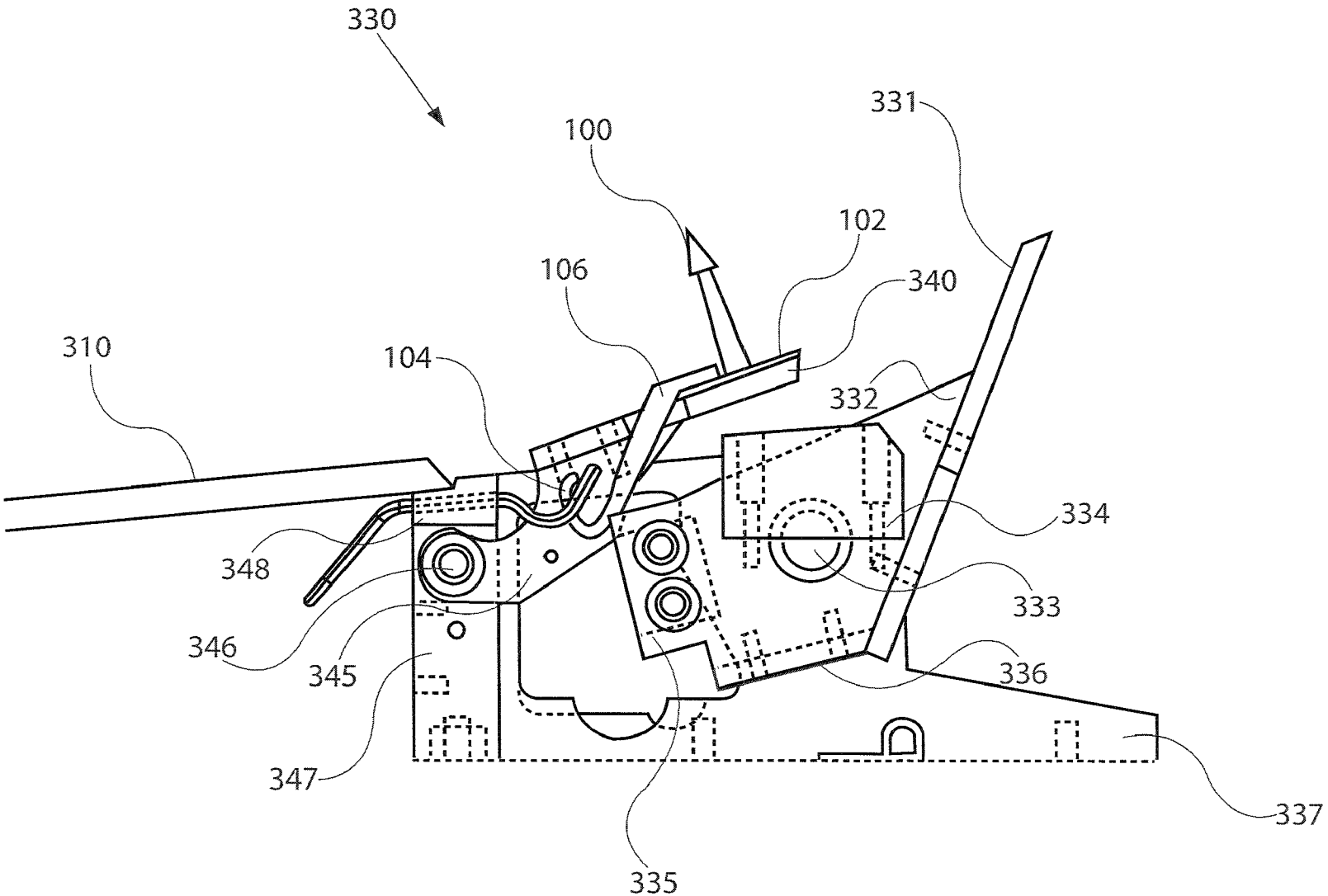
FIG. 22 is a line drawing, side view of one bay, partially transparent, with housing cover halfway open.
Figure 23:
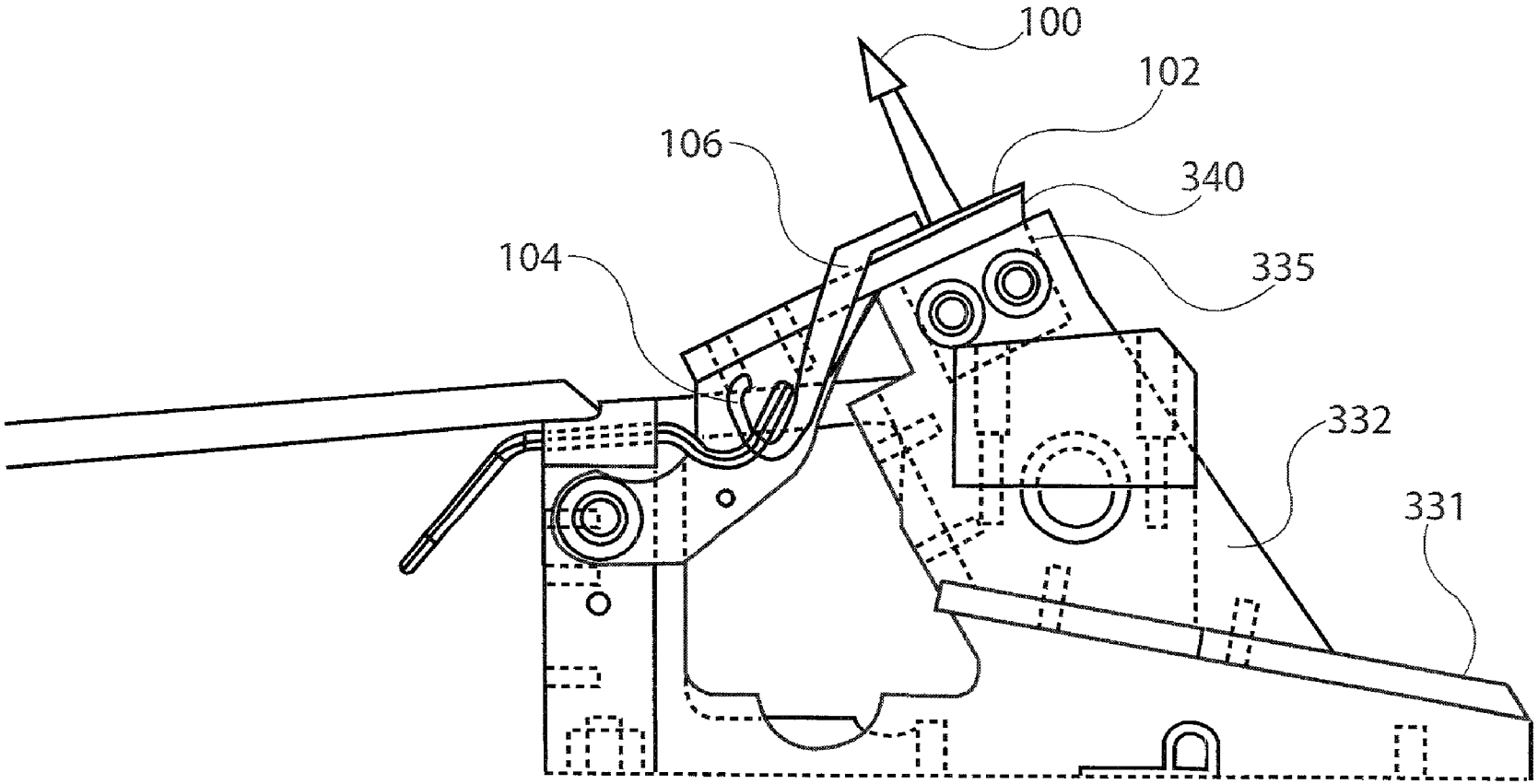
FIG. 23 is a line drawing, side view of one bay, partially transparent, with housing cover completely open.

FIGS. 13 and 14 depict a third embodiment of the invention in that the housing cover may be of a roll-top design. As in the previous embodiments, the spikes are contained within the housing below the cover when the cover is closed. The spikes will be necessarily hidden from traffic beneath the roll-top 250 in the configurations shown, however upon rotation of the top, the spikes are exposed, as shown in the following FIG. 14. FIG. 13 shows this embodiment with the roll-top in the closed configuration, and FIG. 14 shows in close-up the spikes exposed A fourth preferred embodiment of the invention is shown in FIGS. 17-26. Since it is similar in overall design to the first preferred embodiment, it shares some component parts with the embodiment shown in FIGS. 6-9, and so mainly the differences will be highlighted. FIGS. 17 and 18 show front and rear views, respectively, of one section of the vehicle capture device 300. A single module is shown which module is approximately 54 inches long and has nine separate bays that each contain a pair of spike bases 102 (not shown in the closed configuration). Detachable ramp 320 is attached to the cavity cover 310 (closed) which serves as the container for the net when the net cartridge is installed (not shown), and housing cover 331 is closed and covering the spikes 100 (spikes shown in FIGS. 19-21). Cavity cover 310 is hinged similarly to the previous design so that it may be flipped back to reveal the cavity that holds the net. Housing base 338 serves as the base for both the housing 330 and the cavity 310. Housing cover 331 is similar to cover 31 from FIGS. 6-9 and has the same basic functions. However, housing cover 331 has some notable differences, which will now be pointed out. As best seen in FIGS. 21-23, housing cover 331 is part of an assembly additionally including housing cover bracket 332, down ramp 336 and spike ledge support 335. All four components are attached together as shown using machine screws or the like. Housing cover 331 is connected to housing cover bracket 332 with machine screws; down ramp 336 is attached to housing cover bracket 332 at their mutual edges; and spike ledge support 335 is joined to housing cover bracket 332 so that when the assembly is in the fully open position spike ledge support 335 is in direct contact with and beneath spike platform 340, as best seen in FIG. 23. The housing cover assembly has essentially two positions, Open and Closed, with the Open position illustrated in FIG. 23, and the Closed position in FIG. 21. In the Closed position the leading edge of housing cover 331 contacts and rests on housing cover support tie bar 348, down ramp 336 is at approximately a 45 degree down angle to housing cover 331, and spike ledge support 335 is positioned opposite and away from the inside of the housing. In order to transition from the Closed to Open positions, housing cover bracket 332 rotates about the housing cover bracket axle 333 to move the spike ledge support 335 from its external position through approximately 200 degrees of rotation clockwise until it sits squarely beneath and in supporting contact with the spike platform 340, as best seen in FIG. 23. During the rotation process the spikes are raised from their closed position to the open position at the urging of spike ledge support 335, thereby revealing the spikes 100 to any oncoming motor vehicle's tires. The housing cover bracket axle 333 is segmented across the entire length of the module however in actual operation it allows rotation about a common axis engaging all of the housing cover brackets so that all covers in a module are moved simultaneously when the motor drives them.

Figure 24:
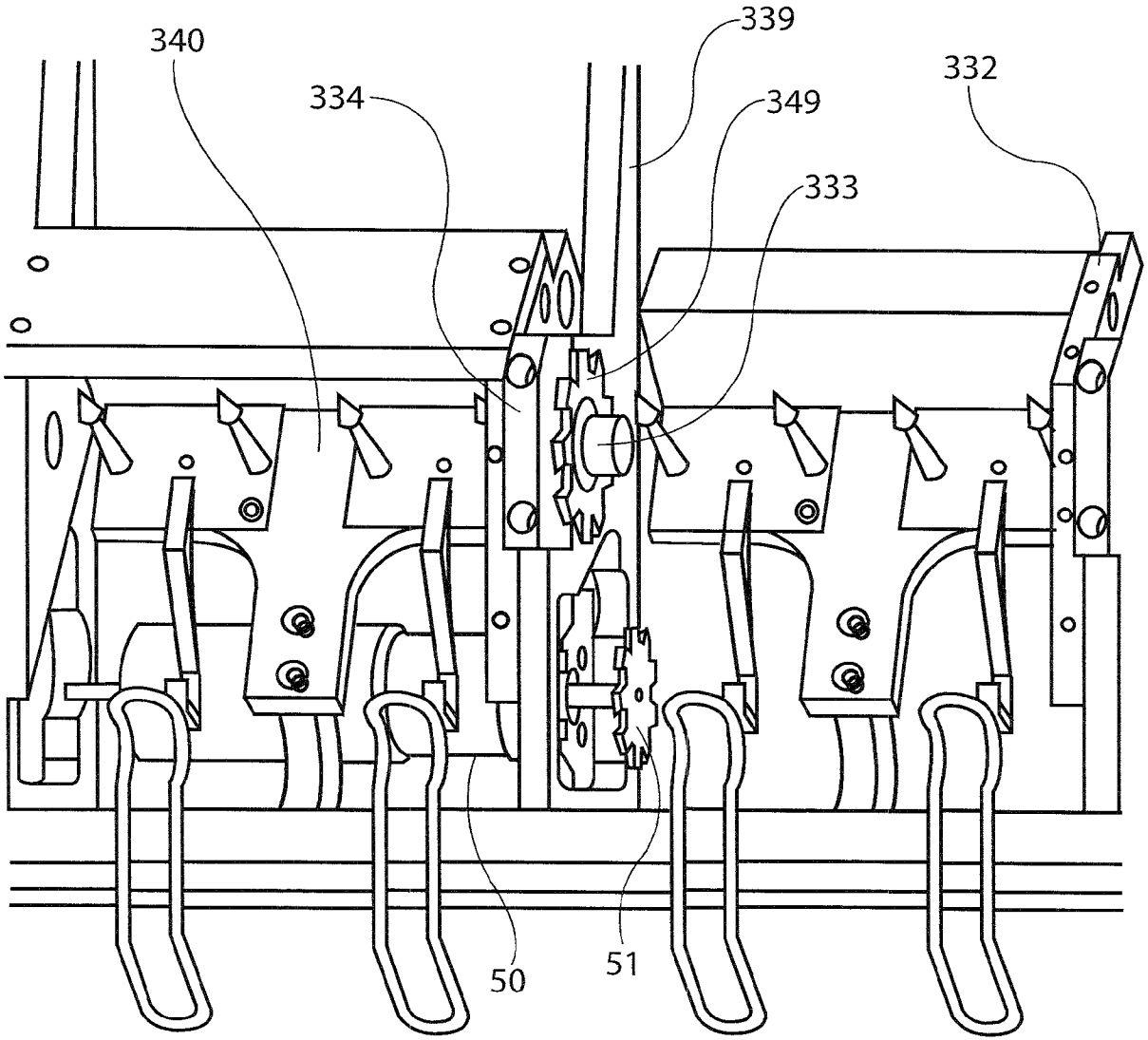
FIG. 24 is a partially disassembled top-down view of a gray-scale drawing showing the motor and drive train in two bays side-by-side.
Figure 25:
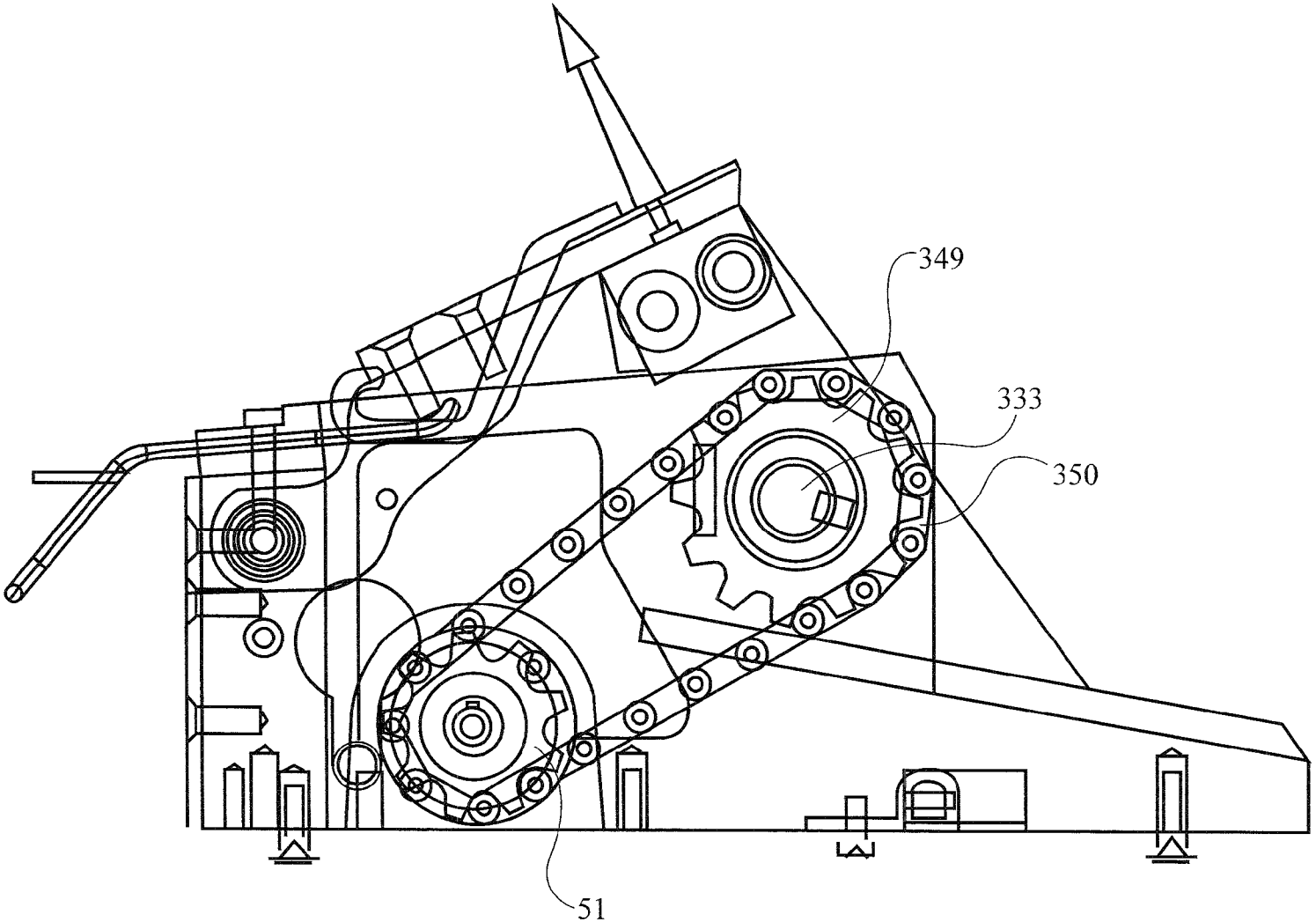
FIG. 25 is a line drawing side view of one bay, partially transparent, with housing cover halfway open, showing the chain drive mechanism.

Rotation of the housing cover assembly is accomplished, as in the previous embodiments, by transfer of rotational motion through an electric motor and interconnected gears and/or chains. FIG. 24 shows a bay partially disassembled to reveal the motor 50 positioned on the base 338 within the housing below the spike platform 340 and displaying a drive gear 51 through which the motor transfers motion to housing cover gear 349 which is locked in place on housing cover bracket axle 333. A bicycle chain 350 (see FIG. 25) or similar chain engages both gears and transfers motion from the drive gear to the driven housing cover gear 349. The axle has a slot which mates with a ridge in the hole of housing cover bracket 332 that receives axle 333. As the motor is energized it causes, through the previously discussed gears and chain, axle 333 to turn which in turn rotates the housing cover assemblies approximately 200 degrees clockwise, thus both exposing the spikes by lifting the covers, and raising the spike platforms through the urging of the spike ledge supports 335, a part of the housing cover assembly previously described. Spike platform 340 is supported on a single support arm 345 which in turn is rotatably affixed to support post 347 at support arm pin 346 which allows for rotation as the spike platform 340 is urged from its lower position to its full exposed and raised position.

FIG. 26 shows the fourth embodiment wherein four vehicle capture devices 300 are combined edge-to-edge and are shown as the multi-housing vehicle capture device 305. Four cartridges 315 for containing individual nets are shown above their respective vehicle capture device sections, and will fit into position immediately aft of the housing section 330. Each cartridge 315 will hold an individual net (not shown here) as mentioned previously. The edges of the individual nets are linked together through the use of carabiner clips or similar attachment devices so that the nets will act as a single, individual net would.

With respect to all embodiments of the vehicle capture device, an actuator that transmits an electronic command to expose the spikes to the vehicle is used by the operator to activate the raising or lowering of the housing cover. The actuator is defined to be a mechanism for opening or closing the cover of the housing to expose or alternatively to cover the spikes. In a preferred embodiment, the actuator device may be a combination of a hand-held wireless transmitter device such as a cell phone, and a receiver which is attached to the motor located inside the housing. Upon receipt of the signal, the motor will then be instructed to open or close the cover, depending on the specific signal received. In other embodiments the actuation function is accomplished by use of a hard-wired connection to the units and their respective motors simply by pushing a button, or transmitting a number or series of numbers on a keypad. It is likely that no matter what specific actuation embodiment is chosen, electronic signal transmission will be the preferred embodiment. For example, the wireless signal transmission device may vary from a radio transmitter to an infrared transmitter. Devices and methods of transmitting signals are well known to one of ordinary skill. Non-electrical actuators may include pneumatic hoses, manually-pulled wire cables, etc. It is well within the level of ordinary skill in the art to select different methods of non-electrical signal transmission.

Figure 15:
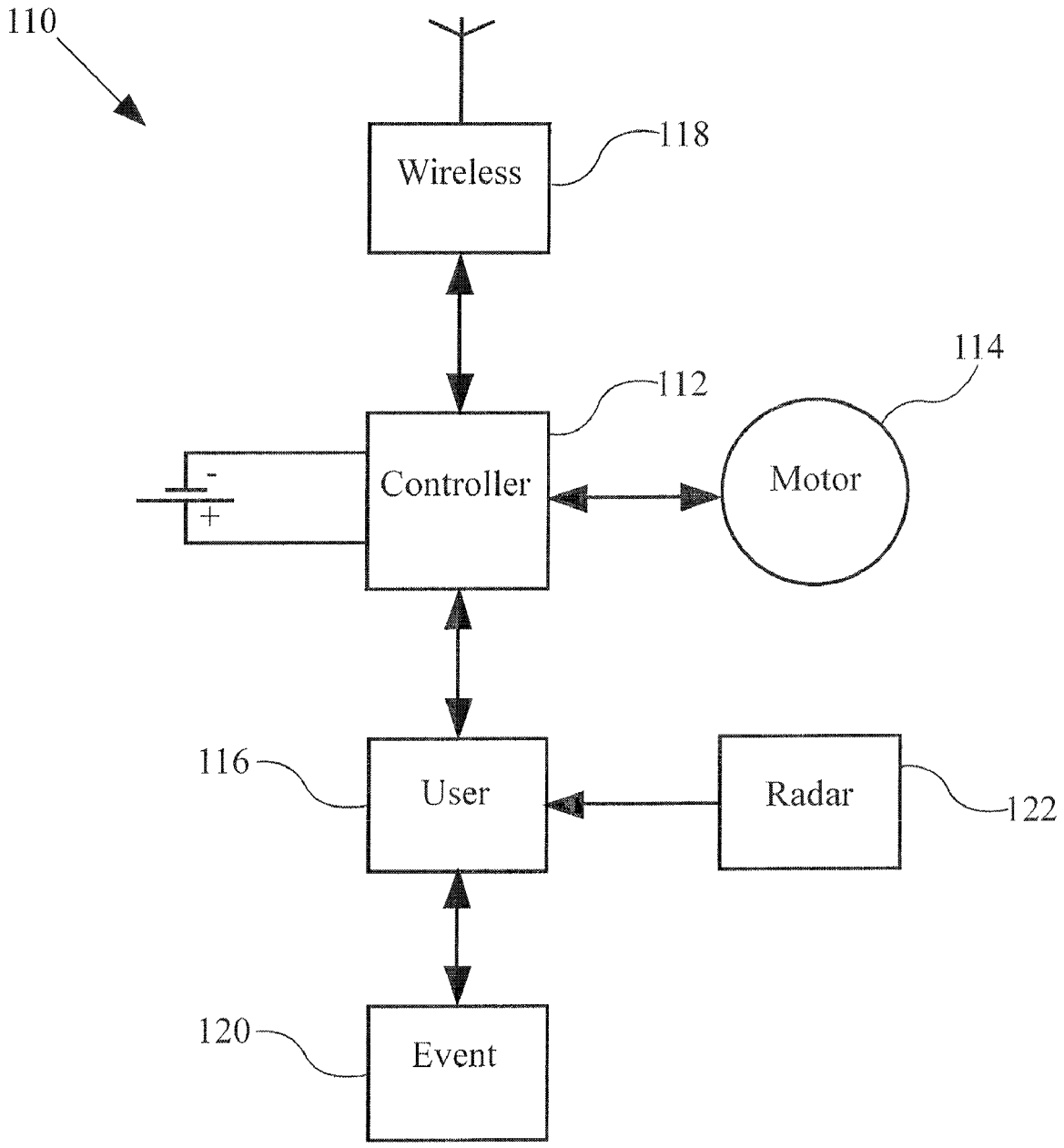
FIG. 15 is a block diagram of the electronics of the actuator.

FIG. 15 is a block diagram of one possible electronic configuration of an actuation mechanism 110. The motor 114 and controller 112 are located within the housing of the preferred embodiments. They are in constant bi-directional electronic communication, as shown by the double arrows. Controller 112 is a typical multi-input digital motor controller such as a Model VNH3SP30 available from ST Microelectronics, Geneva, Switzerland. Its main function is to trip the motor on or off for the time necessary to move the housing cover to either a fully open or fully closed state. Electric motor 114 is a DC or AC-powered motor, and is a Maxon model 223288. There are three main control interfaces used to activate and control the motor. Each system has a modem to communicate with a remote control (Modem transceiver 118), a hand held controller (User controls 116) and sensor interface (not shown). The modem transceiver 118 is used for remote control of the device to allow the user to position themselves at a safe distance from the system or at a temporary installation. The modem transceiver decodes radio commands from the transceiver and operates the motor to either the "open" or "closed" position when a valid command is sensed. This position is then held until the system detects a valid command to change this state. The hand held user controls 116 can be used in a controlled environment that houses a permanent or semi-permanent building. The hand held controller decodes commands from the user via buttons and operates the motor to either the "open" or "closed" position when a valid command is sensed. This position is then held until the systems detects a valid command to change this state. The sensor interface can be used to interface with radar or other sensors for automatically deploying the system. The radar interface can be used to monitor speed sensing devices to detect when a vehicle is approaching at a predetermined speed. The event trigger 120 can be used to activate the device or it can be connected to another vehicle stopping system to activate the device when, for example, another event such as the deployment of another vehicle capture device or another manual trigger has occurred.

Figure 16:
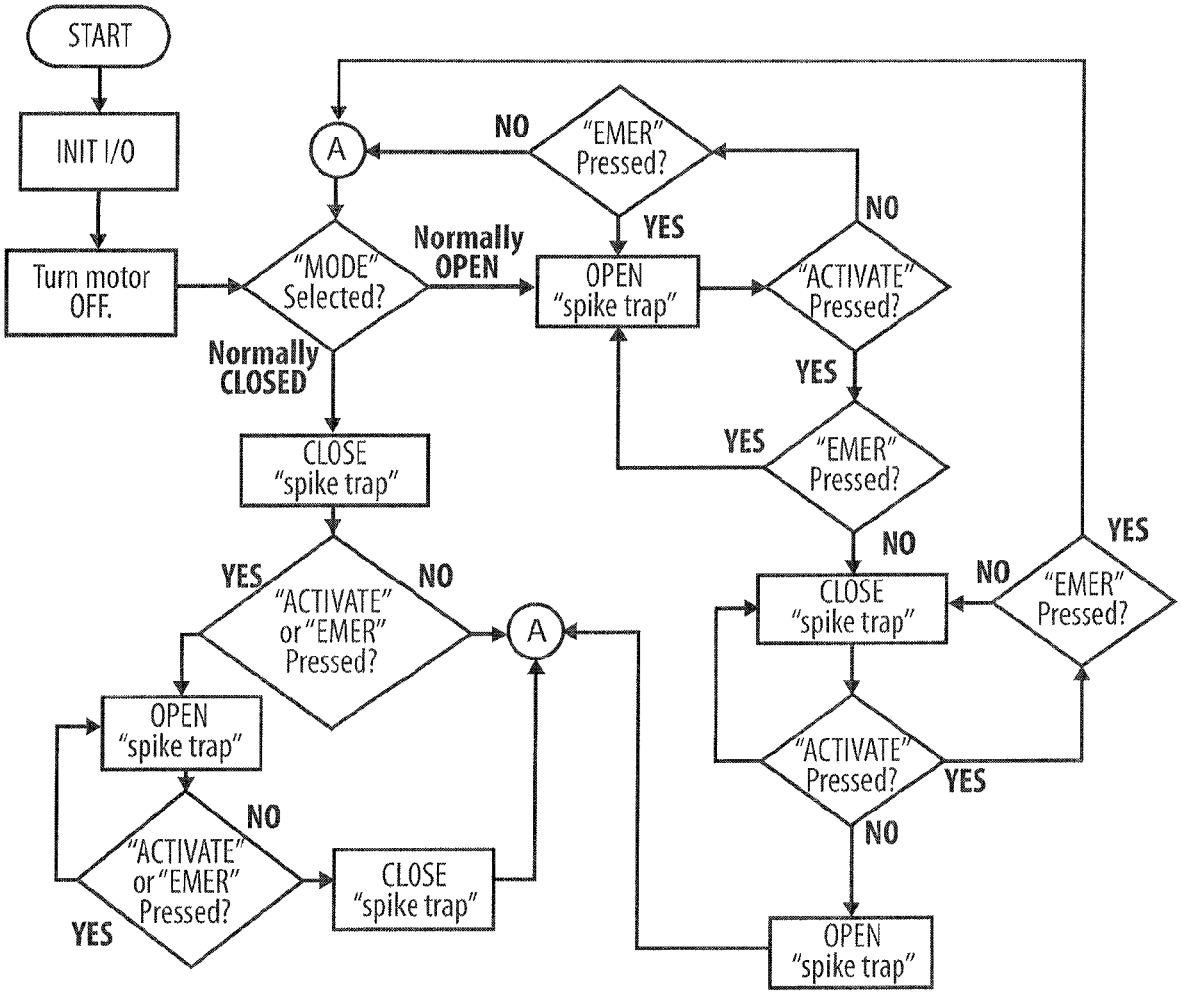
FIG. 16 is a logic chart of the actuator's operational functions.

The firmware utilized in this design allows for the system to process each command and act appropriately. If the system receives an unrecognized command it will ignore it and keep monitoring all of the other inputs until a correct procedure is received. With attention directed to FIG. 16, a logic diagram of the firmware is shown. At initial start-up of the system the housing cover is automatically placed in the closed position to be placed in a known position. This allows the system to correct for any potential errors at setup or when the system is first turned on. Currently there are dual modes of operation, "Normally Open" and "Normally Closed". Normally Open has the housing cover always open and the spikes exposed, and the user then presses and holds the control button (not shown) to close the cover. When the user releases the control button, the housing cover goes back into the open state. Normally Closed mode has the housing cover always closed, and the user then presses and holds the control button to open the housing cover. When the user releases the control button, the housing cover goes back into the closed state. If the user presses the "Emergency" button, the housing cover goes into the open position until the control button is released.

Figure 10:
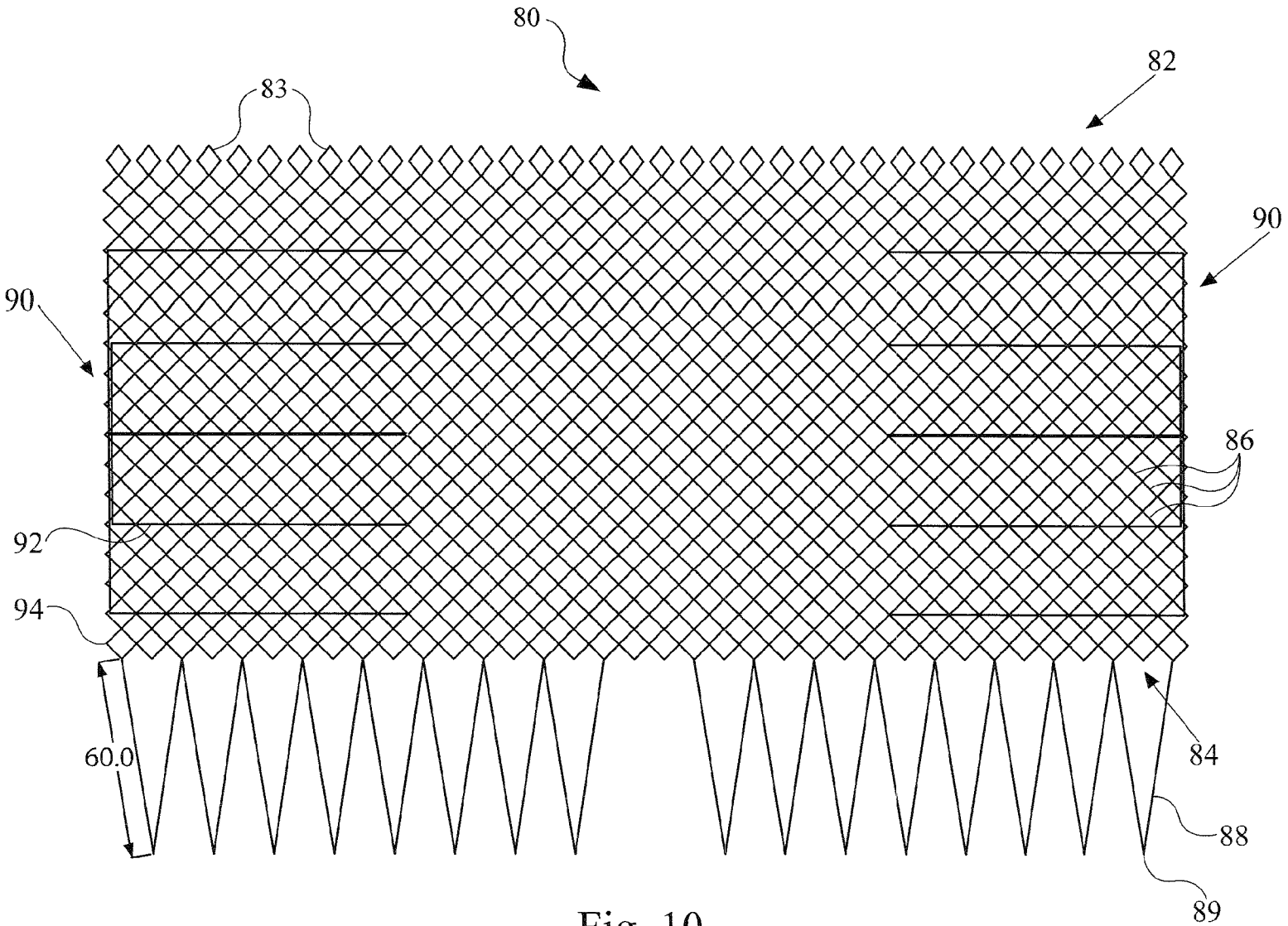
FIG. 10 is a schematic representation of the net of an embodiment of the present invention.

With attention directed to FIG. 10, a preferred embodiment of the net 80 is shown. The net 80 serves the central function of wrapping the tires and axles until it tightens, and then completely stops the wheels from turning. The body of the net is substantially rectangular as shown due to the need for the net to stretch laterally, that is, from side-to-side. The ability to stretch is necessary due to the function of the net, which is to entangle, tighten, and then stop the wheels. To illustrate this process, as the net tightens its cells 86 stretch laterally until they reach their limit and impede any further rotation of the tires. Net 80 is a series of diamond-shaped interwoven cells 86 comprising a leading edge 82 adapted to engage the tires, and a trailing edge 84. The leading edge 82 comprises loops or partially disconnected cells called "leaders" 83 of material integrally connected to the net, the loops forming openings sufficient to allow the spikes to grasp the net when the housing is actuated to the "spikes exposed" position. The trailing edge 84 of the net 80 has elastic components 88 attached intermittently to the trailing edge of the net. The elastics may be bungee cords, rubber bands or similar elastic material. The elastic terminus 89 will normally be anchored to the ground or within the cavity itself or to some other immobile surface in breakaway design, that is, as the trailing edge of the net is pulled free of the housing cavity the net will begin to stretch the elastics until they break away from their mounting. The elastics' function is to retard but not prevent egress of the net from the cavity. The problem that the inventors encountered was that the net in some instances would be pulled too quickly from the housing resulting in the net ricocheting off the tire, thereby frustrating smooth enwrapment of the tire. The elastics temporarily restrain the net, thereby providing a smoother uptake of the net around the tire. The net is made of a strong yet resilient material such as a synthetic rope or mesh netting. A preferred material is polypropylene rope, or even more preferred is DYNEEMA® brand rope from DSM DYNEEMA, Greenville, N.C.

A second innovation in the design of this net are the edge treatments 90, which are designed to minimize the amount of net required outboard of the wheel to stop a vehicle by taking advantage of the lateral expansion of the net as it engages with suspension components and begins to retard wheel rotation. The edge treatments 90 are best seen in FIG. 10 and comprise lateral ropes or "stringers" 92. The stringers thread through net cells along the edge, and then through net cells laterally inward, where they attach at another inner cell junction. In this embodiment the stringers are 60 inches in length as measured from the edge of the net to the inner cell junction. However, one of ordinary skill in the art will be able, through routine experimentation, to determine the precise length of the edge treatments for any particular application. As the net

80 expands laterally, the lateral stringers 92 of the edge treatment 90 are pulled inboard, shortening the length of the edge treatment running along the net side 94 and decreasing the effective edge length of the net. Shrinking the effective edge length of the net in this manner creates a cinching effect for the net outboard of the wheel (similar to a bag with a drawstring top), causing the net to tighten around the outside face of the wheel and preventing the net from being pulled off the wheel inboard as the net tightens around the suspension components.

The edge treatments 90 are created from two separate pieces of 5/16" diameter DYNEEMA® brand rope per edge. DYNEEMA brand polyethylene rope is preferred, although similar high-strength ropes may also be substituted in the net of the invention. The two pieces of rope are staggered to maximize the cinching effect. A preferred embodiment is composed of five lateral stringers, three from one continuous piece of rope and two from another, separate continuous piece of rope. Additionally, the offset design with multiple pieces of rope is more effective than a single length of rope (the drawstring example) because in addition to the cinching action, it creates a separate "net" on the outside of the wheel that helps hold the body of the net in place. The DYNEEMA is used so that the edge treatments have the same abrasion resistance and load-carrying capacity as the rest of the net. The ends of the edge treatments are simply tied to the net at cell intersections and then woven between each cell of the net to loosely hold it into place.

Figure 27:
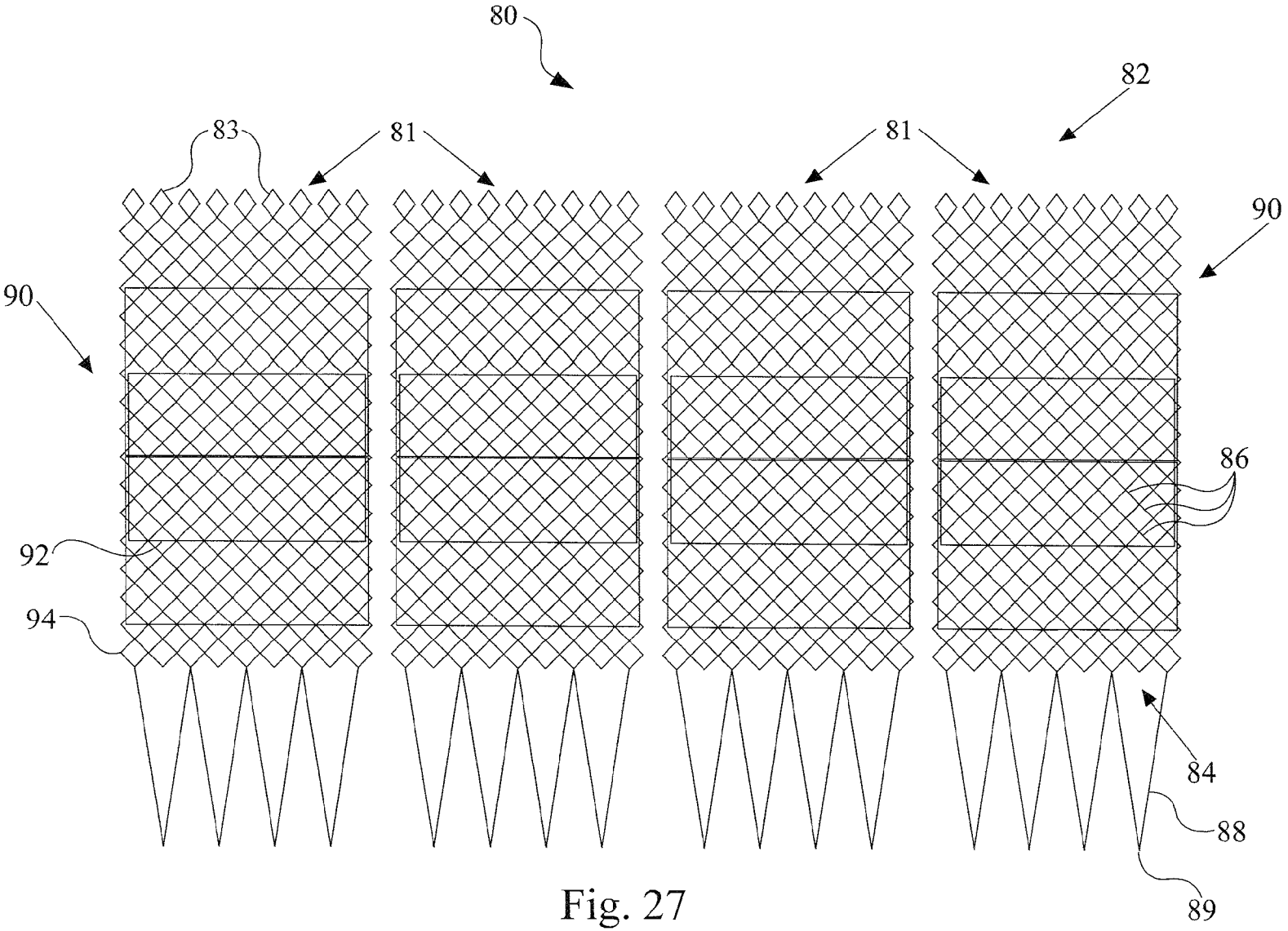
FIG. 27 is a schematic representation of a group of four individual nets of a second embodiment of the present invention.
Figure 28:
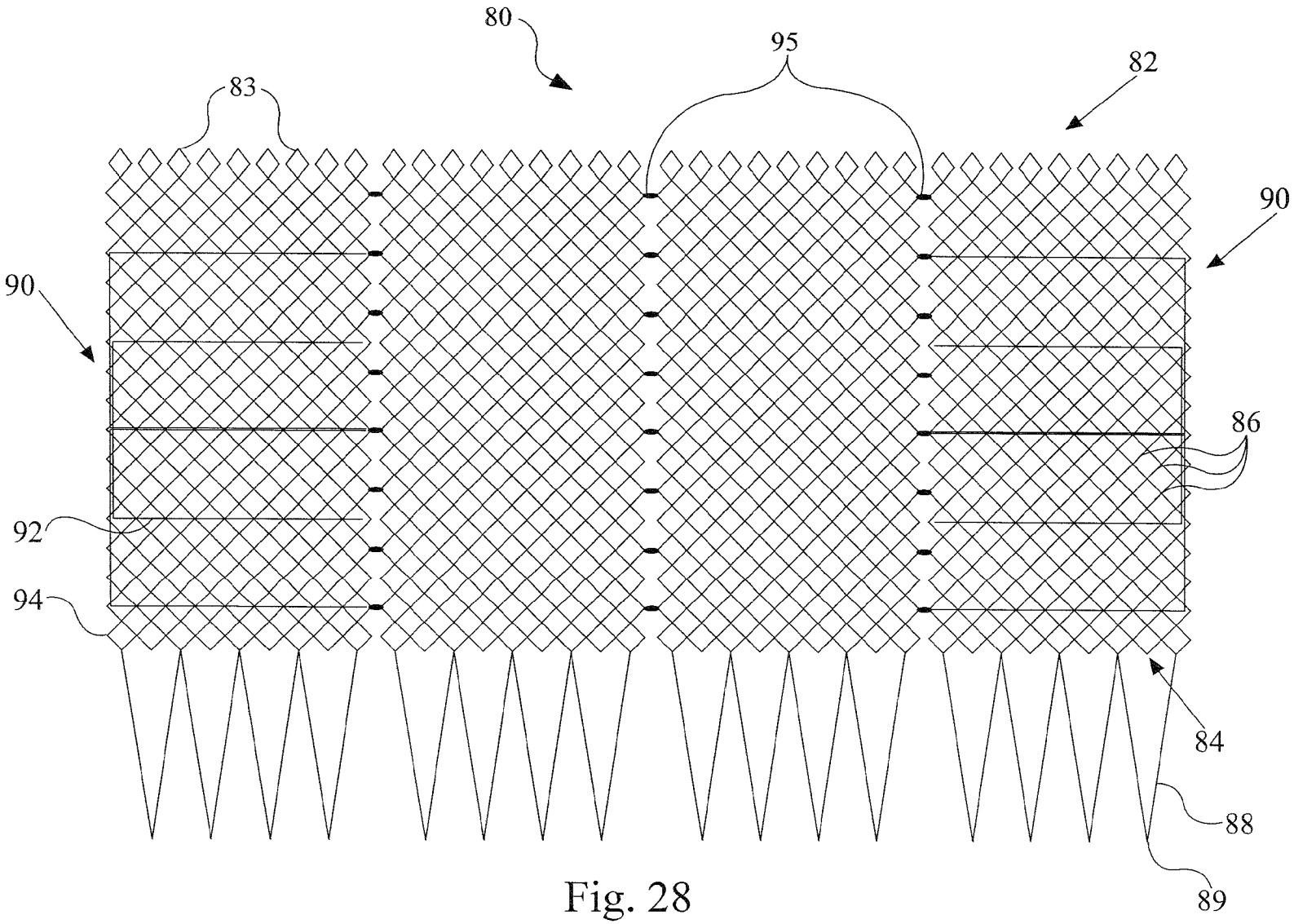
FIG. 28 is a schematic representation of a group of four individual nets of a third embodiment of the present invention.

Other preferred embodiments of the net 80 are seen in FIGS. 27-28 wherein individual nets may be used either together (FIG. 28) or separately (FIG. 27) in combination with the housings of the invention. FIG. 27 is a plan view of four individual nets 81. The individual nets are similar to the net 80 design in that they all have a leading edge 82, leaders/loops 83, trailing edge 84, cells 86, elastic components 88 and elastic terminus 89. The embodiment of FIG. 27 differs in that the edge treatments have been modified so that the edge treatments extend from side-to-side given the shorter width of the nets of approximately 54 inches. The edge treatments in this embodiment are laid out in a three-box design wherein the treatments comprise two rectangular box patterns that are contiguous at their shared periphery, and the third box pattern is overlaid on top of and centered between the two-box pattern below. The effect is to have constructed lateral stringers 92, 5 of them in this embodiment.

FIG. 28 shows another embodiment of the individual net 81, this one having a different stringer pattern due to the carabiner clips 95 being used to connect multiple individual nets together at their internal peripheries. In this embodiment the four individual nets are joined using a quick-connect type attachment means such as steel carabiners. In this embodiment the four individual nets comprise a left net, a right net, and two internal nets. The internal nets have no stringers while the left and right nets must each have stringers. In this embodiment, the stringer pattern is the same as in the net 80's original design.

Test Data

The following data were collected during testing of the embodiments of the invention discussed above, which data is presented in partial support of the utility of the inventions. The second and fourth embodiments were used during some of the testing, while additional tests were conducted using wooden housing mock-ups. The primary net embodiment is depicted in FIG. 10, however variations of this design were also tested. The testing was conducted with both loose and cartridge-enclosed net systems. The underlying design of a net deployed from a housing module was included in the all the embodiments tested. The vehicles tested include a small passenger car (1998 Honda Civic Coupe), a mid-size pickup (1998 Chevy 1500), a heavy-duty pickup with dual rear wheels (1999 Ford F-350) and a heavy bobtail truck (1997 International 9400). A variety of vehicles and loading conditions were included to cover a wide range of typical vehicle parameters like total vehicle weight and weight distribution, vehicle geometry such as wheelbase, and tire size.

Repeatability tests were conducted for several configurations. The tests were conducted at a speed of 30 mph with no throttle application after initial net engagement. As indicated in Table 1, the reported stopping distances are approximate.

TABLE 1

| Vehicle | Weight (lbs) | Speed (mph) | Stopping Distance (ft) |
|---|---|---|---|
| Coupe | 2,310 | 30 | ≈60 |
| Pickup | 5,000 | 30 | ≈75 |
| Pickup | 9,000 | 30 | ≈90 |
| Heavy Truck | 20,000 | 30 | ≈110 |
| Heavy Truck | 51,000 | 30 | ≈250 |

As can be seen from the data in the "Coupe" entry, a medium-sized car was stopped in approximately 60 feet using the disclosed invention, while a heavy truck took considerably longer (250 feet) to stop.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in the above even when not initially claimed in such combinations.

The words used in this specification to describe the various embodiments of the invention are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention. All patents and references cited herein are explicitly incorporated by reference in their entirety.

We claim:

1. Apparatus for inhibiting the rotation of the tires of a vehicle comprising:

a housing located at or below ground level having a cavity adapted to releasably contain a net having spikes arranged at a leading edge of the net; and an actuator that transmits an electronic command to expose the spikes to the vehicle, wherein the spikes comprise at least two barbs adapted to penetrate a pneumatic tire, the spikes also having a hook for grasping a loop of the leading edge of the net.

2. The apparatus of claim 1 wherein the housing is below ground.

3. The apparatus of claim 1 wherein the housing is above ground.

4. The apparatus of claim 3 wherein the housing comprises a ramp for oncoming traffic whereby the oncoming traffic will normally slow in response to the presence of the ramp.

5. The apparatus of claim 1 wherein the housing comprises more than one section.

6. The apparatus of claim 1 wherein the housing comprises multiple housing sections that interlock with one another and together house a single unitary net.

7. The apparatus of claim 6 wherein the multiple housing sections each comprise an individual net, each net having connectors that connect the individual nets at their lateral peripheries.

8. The apparatus of claim 1 wherein the net comprises a leading edge adapted to engage the tires and a trailing edge.

9. The apparatus of claim 1 wherein the longitudinal edges of the net comprise lateral stringers attached at an inner cell junction and threaded through the cells towards the edge, and then attached at an outer edge of cell junction.

10. The apparatus of claim 1 wherein the spikes are supported on a platform that is moveable between the exposed and unexposed positions.

11. The apparatus of claim 10 wherein the housing platform comprises supporting ledges for the spikes.

12. The apparatus of claim 1 wherein the command comprises electromagnetic signals received by the housing for positioning the spikes in the spikes exposed or spikes unexposed positions.

13. The apparatus of claim 1 wherein the actuator comprises a wirelessly-activated electric motor.

14. The apparatus of claim 8 wherein the trailing edge of the net comprises a releasable elastic restraining element.

15. The apparatus of claim 14 wherein the releaseable elastic restraining element of the net comprises elastic members releasably attached to the housing whereby upon being fully stretched thereafter the elastic members will tear away from the housing.

16. A cartridge containing the net of claim 1.

17. Apparatus for inhibiting the motion of a vehicle comprising:

a housing located at or below ground level having a cavity, the cavity adapted to contain a net so that the net may be made available for release on command;

tire engagement spikes supported by the housing, the spikes comprising at least two barbs adapted to penetrate a pneumatic tire, the spikes also having a hook for grasping a loop of the leading edge of the net, the spikes being movable to a first position to engage the tires of an oncoming vehicle, the spikes also being movable to a second position to avoid tire engagement, the spikes being positioned to grasp the net when in the first position; and an actuator for moving the spikes between the first and the second positions on command.

18. The apparatus of claim 17 wherein the housing is below ground.

19. The apparatus of claim 17 wherein the housing is above ground.

20. The apparatus of claim 19 wherein the housing comprises a ramp for oncoming traffic whereby the oncoming traffic will normally slow in response to the presence of the ramp.

21. The apparatus of claim 17 wherein the housing comprises more than one section.

22. The apparatus of claim 17 wherein the housing comprises multiple housing sections that interlock with one another and together house a single unitary net.

23. The apparatus of claim 17 wherein the net comprises a leading edge adapted to engage the tires and a trailing edge.

24. The apparatus of claim 17 wherein the longitudinal edges of the net comprise lateral stringers attached at an inner cell junction and threaded through the cells towards the edge, and then attached at an outer edge of cell junction.

25. The apparatus of claim 17 wherein the leading edge comprises spikes anchored in or around the leading edge of the net.

26. The apparatus of claim 17 wherein the tire engagement spikes are supported on a platform that is moveable between the first and second positions.

27. The apparatus of claim 26 wherein the housing platform comprises supporting ledges for the spikes.

28. The apparatus of claim 17 wherein the command comprises electromagnetic signals received by the actuator for positioning the spikes in the first position or the second position.

29. The apparatus of claim 17 wherein the actuator comprises a wirelessly-activated electric motor.

30. The apparatus of claim 17 wherein the trailing edge of the net is connected to a releasable elastic restraining element.

31. The apparatus of claim 30 wherein the releasable elastic restraining element comprises elastic members releasably attached to the housing whereby upon being fully stretched the elastic members will thereafter tear away from the housing.

32. A cartridge containing the net of claim 17.

33. A method for inhibiting the motion of a moving vehicle, comprising the steps of:

providing a housing located at or below ground level in the path of the vehicle, the housing being adapted to releasably contain a net having spikes arranged at a leading edge of the net, wherein the spikes comprise at least two barbs adapted to penetrate a pneumatic tire, the spikes also having a hook for grasping a loop of the leading edge of the net; and transmitting an electronic command manually to a motor that exposes the spikes to the moving vehicle.

34. The method of claim 33 further comprising the step of transmitting an electronic command automatically to a motor that exposes the spikes to the moving vehicle.

35. The method of claim 33 wherein the vehicle is selected from amongst a group of vehicles.

36. The method of claim 33 further comprising engaging the front tires of the vehicle by puncturing them with the spikes.

37. The method of claim 36 further comprising wrapping the net around the front tires as they continue to rotate.

38. The method of claim 37 further comprising tightening the net around the axles of the vehicle whereby forward motion is significantly constrained.

39. A method of inhibiting the motion of a moving vehicle comprising the steps of providing a housing located at or below ground level having a cavity in the path of the vehicle, the housing being adapted to releasably contain a net having spikes arranged at a leading edge of the net, wherein the spikes comprise at least two barbs adapted to penetrate a pneumatic tire, the spikes also having a hook for grasping a loop of the leading edge of the net;

transmitting an electronic command manually to a motor that exposes the spikes to the moving vehicle;

engaging the tires of the moving vehicle with the spikes by puncturing them;

pulling the net from the housing by wrapping the net around the tires as the tires continue to move forward; and limiting continued forward motion by tightening the net around the axles thereby ultimately constraining the tires from further rotation.

40. The method of claim 39 wherein the moving vehicle is selected from amongst a group of vehicles.

41. The method of claim 39 further comprising the step of transmitting an electronic command automatically to a motor that exposes the spikes to the moving vehicle.

* * * * *